US011261626B2

(12) United States Patent
Kulicki

(10) Patent No.: US 11,261,626 B2
(45) Date of Patent: Mar. 1, 2022

(54) LATCH ASSEMBLY INCLUDING LATCH MODULE WITH RETRACTABLE LATCH BOLT FOR STORAGE COMPARTMENT IN AUTOMOTIVE VEHICLE

(71) Applicant: VOLVO CAR CORPORATION, Gothenburg (SE)

(72) Inventor: Piotr Kulicki, Lindome (SE)

(73) Assignee: VOLVO CAR CORPORATION, Gothenburg (SE)

( * ) Notice: Subject to any disclaimer, the term of this patent is extended or adjusted under 35 U.S.C. 154(b) by 425 days.

(21) Appl. No.: 16/296,877

(22) Filed: Mar. 8, 2019

(65) Prior Publication Data

US 2020/0284070 A1 Sep. 10, 2020

(51) Int. Cl.

| | |
|---|---|
| ***E05B 83/30*** | (2014.01) |
| ***E05C 9/04*** | (2006.01) |
| ***E05B 77/38*** | (2014.01) |

(52) U.S. Cl.

CPC ..... *E05B 83/30* (2013.01); *E05C 9/046* (2013.01); *E05B 77/38* (2013.01)

(58) Field of Classification Search

CPC ..... Y10T 292/0834; Y10T 292/0844; Y10T 292/0838; Y10T 292/0967; E05B 83/30; E05B 77/38; E05B 63/20; E05B 63/18; E05B 63/185; E05C 9/046; Y10S 292/26

USPC ..... 296/37.12

See application file for complete search history.

(56) References Cited

U.S. PATENT DOCUMENTS

| | | | | |
|---|---|---|---|---|
| 1,198,862 | A | 9/1916 | McCormack | |
| 1,548,001 | A | 7/1925 | Furry | |
| 2,566,284 | A | 8/1951 | Eichacker | |
| 7,325,845 | B2 * | 2/2008 | Bartos | B60P 1/003 292/332 |

(Continued)

FOREIGN PATENT DOCUMENTS

| | | | |
|---|---|---|---|
| CN | 2040521 | U | 7/1989 |
| CN | 101323280 | A | 12/2008 |

(Continued)

OTHER PUBLICATIONS

European Search Repod dated Jul. 23, 2020 from corresponding European Patent Application No. 20161248.8; 10 pages.

*Primary Examiner* — Kristina R Fulton
*Assistant Examiner* — Steven A Tullia
(74) *Attorney, Agent, or Firm* — Berenato & White, LLC

(57) ABSTRACT

A latch assembly for a storage compartment in an automobile is disclosed. The latch assembly includes a latch module, including a latch bolt, and a striker. The latch bolt is moveable between an extended latched position, in which the bolt axis is coaxial with a longitudinal axis of the latch casing, and a retracted unlatched position, in which the bolt is withdrawn into, and its axis is oblique with respect to, the latch casing. When in the oblique position, the latch bolt is retained in the unlatched position within the latch casing. A spring member within the latch casing biases the latch bolt to both extend axially from the latch casing, and pivotally toward the inner retaining surface of the latch casing. Upon closure, the bolt is moved, via contact with the striker, from the withdrawn oblique retained position, and returns via spring bias to the latched extended position.

18 Claims, 18 Drawing Sheets

(56) References Cited

U.S. PATENT DOCUMENTS

| | | | | |
|---|---|---|---|---|
| 2003/0193199 | A1* | 10/2003 | Talukdar | E05B 77/42 292/172 |
| 2005/0156433 | A1* | 7/2005 | Nemoto | E05B 83/30 292/163 |
| 2005/0253399 | A1* | 11/2005 | Yamamoto | E05B 83/30 292/201 |
| 2006/0145498 | A1 | 7/2006 | Bartos et al. | |
| 2006/0267364 | A1* | 11/2006 | Katagiri | E05B 83/30 296/37.12 |
| 2007/0182186 | A1* | 8/2007 | Penner | B60R 7/06 296/37.8 |
| 2008/0290685 | A1 | 11/2008 | Ohnuki | |
| 2011/0221211 | A1* | 9/2011 | Weron | E05B 63/20 292/64 |
| 2014/0152026 | A1* | 6/2014 | Cinco | E05B 83/28 292/158 |
| 2018/0230720 | A1 | 8/2018 | Liu et al. | |

FOREIGN PATENT DOCUMENTS

| | | | | |
|---|---|---|---|---|
| DE | 10036945 | A1 * | 2/2002 | E05C 9/041 |
| DE | 102008018667 | A1 * | 10/2009 | E05C 3/162 |
| DE | 102009052633 | A1 * | 5/2011 | E05B 83/30 |
| DE | 202011050968 | U1 | 10/2011 | |
| DE | 202016101113 | U1 * | 4/2016 | E05B 83/30 |
| DE | 102016115622 | A1 * | 3/2018 | B60R 7/06 |
| EP | 1243729 | A2 * | 9/2002 | E05C 9/1875 |
| EP | 1526236 | A2 | 4/2005 | |
| FR | 2817897 | A1 * | 6/2002 | B60R 7/06 |
| KR | 100881739 | B1 * | 2/2009 | E05B 83/30 |
| WO | WO-2005024163 | A1 * | 3/2005 | E05C 9/1875 |
| WO | WO-2015125774 | A1 * | 8/2015 | E05B 83/30 |

* cited by examiner

LATCH ASSEMBLY INCLUDING LATCH MODULE WITH RETRACTABLE LATCH BOLT FOR STORAGE COMPARTMENT IN AUTOMOTIVE VEHICLE

BACKGROUND OF THE INVENTION

1. Field of the Invention

The present invention generally relates to latch systems for storage compartments in automobiles. More particularly, the invention relates to an extended latch bolt assembly for use with a storage compartment of an automobile.

2. Description of the Related Art

Automotive vehicles (or automobiles) are commonly equipped with various storage (or small article) compartments for stowing vehicle accessories, personal belongings and other objects. Normally, storage compartments for accommodating small articles are provided in a passenger compartment or cabin of automobiles.

For example, vehicles typically include a glove box usually located in the dash on the front passenger side of the passenger compartment, armrest storage compartments, closed driver storage compartments, etc. The glove box has a housing typically installed with the dash and has walls that generally define a compartment with an open front side. A pivoting lid or door is pivotally connected to the housing such that the lid pivots between an open position in which the compartment is accessible and a closed position in which access is prevented. The lid typically has a latch assembly for latching the door closed and is actuatable by a user to release the door and allow it to open. A conventional latch may include a pull lever that releases a latch and enables a user to pull the door open.

Currently used latch assemblies have issues with increased closing force, initial impact noise and parts deformation during closing. It is caused by latching bolts remaining extended when in an open hatch condition. During closing of a lid of a storage compartment, the latch bolts hit fixed parts of a storage bin and have to be pushed into a recess before latching can occur.

Thus, while latch assemblies for storage compartments of an automobile, including but not limited to that discussed above, have proven to be acceptable for vehicular applications and conditions, improvements that may enhance and quiet their performance are possible.

SUMMARY OF THE INVENTION

According to the invention, there is provided a latch assembly for a storage compartment in an automotive vehicle. The latch assembly is adapted to selectively secure a lid to a storage bin of the storage compartment. The latch assembly has a latched position and an unlatched position. When latched, a latch bolt extends from within a latch casing and engages an opposed anchor pocket/striker so as to secure the lid. When unlatched, the latch bolt is withdrawn into, and retained within, the latch casing until such time as the lid is again closed, and by action of the latch bolt against the anchor pocket/striker, the latch bolt is released and extends via a bias spring into the anchor pocket/striker and retains the lid in a closed position.

The latch assembly includes a first latch module, which comprises a hollow latch casing, an elongated latch bolt extending through the cavity in the hollow latch casing, and a spring member disposed within the cavity in the hollow latch casing. The hollow latch casing forms a cavity and has an inner retaining surface within the cavity, a front opening and a rear opening coaxial with the front opening along a longitudinal casing axis of the hollow latch casing. The spring member has a bolt spring end engaging the elongated latch bolt and a casing spring end engaging the hollow latch casing. The elongated latch bolt has a free distal end and a proximal end disposed along a longitudinal bolt axis of the elongated latch bolt, and an outer retaining surface configured to cooperate with the inner retaining surface of the hollow latch casing and disposed between the free distal end and the proximal end of the elongated latch bolt. The elongated bolt body is moveable axially and pivotally relative to the latch casing. The elongated latch bolt is moveable between an extended position, in which the longitudinal bolt axis of the latch bolt is coaxial with the longitudinal casing axis of the latch casing, and a retracted position, in which the longitudinal bolt axis of the latch bolt is oblique with respect to the longitudinal casing axis of the latch casing. The spring member biases the free distal end of the elongated latch bolt axially away from the latch casing and biases the outer retaining surface of the elongated latch bolt pivotally toward the inner retaining surface of the latch casing so that the elongated latch bolt retained both in the extended position and the retracted position by the spring member. The outer retain surface of the elongated latch bolt engages the inner retaining surface of the latch casing in the retracted position of the elongated latch bolt. The outer retaining surface of the elongated latch bolt is disengaged from the inner retaining surface of the latch casing in the extended position of the elongated latch bolt. The spring member biases and retains the elongated latch bolt toward the retracted position when the outer retaining surface of the latch bolt is engaged with the inner retaining surface of the latch casing. The spring member biases the elongated latch bolt toward the extended position when the outer retaining surface of the elongated latch bolt is disengaged from the inner retaining surface of the latch casing.

Other aspects of the invention will become more apparent upon reading the following detailed description of the exemplary embodiments.

BRIEF DESCRIPTION OF THE DRAWINGS

The accompanying drawings are incorporated in and constitute a part of the specification. The drawings, together with the general description given above and the detailed description of the exemplary embodiments and methods given below, serve to explain the principles of the invention. In these drawings.

DETAILED DESCRIPTION OF THE PREFERRED EMBODIMENTS

Figure 1:
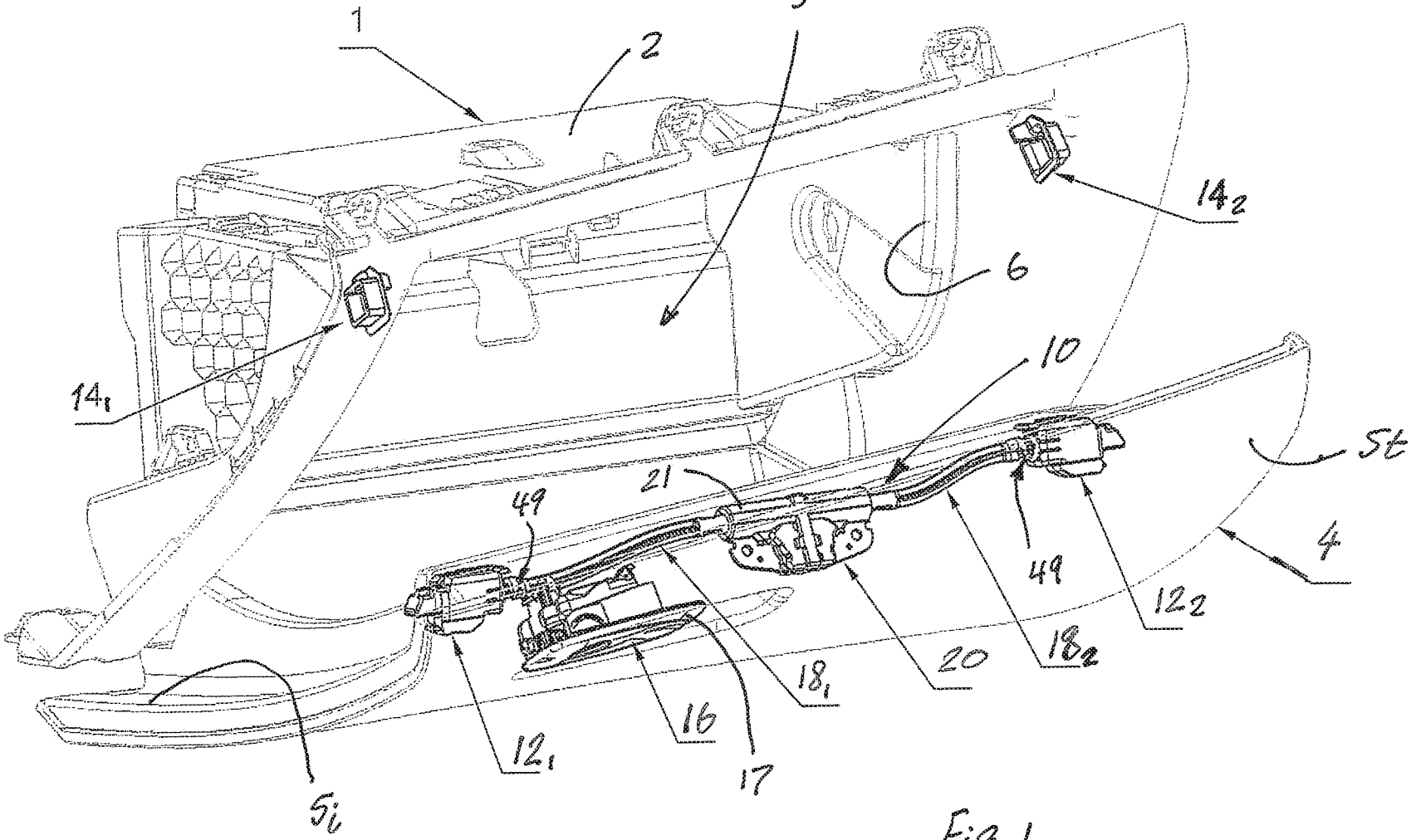
FIG. 1 is a perspective view of a glove box according to an exemplary embodiment of the present invention.

Reference will now be made in detail to an exemplary embodiment and methods of the invention as illustrated in the accompanying drawings, in which like reference characters designate like or corresponding parts throughout the drawings. It should be noted, however, that the invention in its broader aspects is not limited to the specific details, representative devices and methods, and illustrative examples shown and described in connection with the exemplary embodiments and methods.

This description of exemplary embodiments is intended to be read in connection with the accompanying drawings, which are to be considered part of the entire written description. In the description, relative terms such as "horizontal," "vertical," "front," "rear," "left," "right," "upper," "lower," "top," and "bottom" as well as derivatives thereof (e.g., "horizontally," "downwardly," "upwardly," etc.) should be construed to refer to the orientation as then described or as shown in the drawing figure under discussion and to the orientation relative to a vehicle body. These relative terms are for convenience of description and normally are not intended to require a particular orientation. Terms concerning attachments, coupling and the like, such as "connected" and "interconnected", refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. The term "integral" (or "unitary") relates to a part made as a single part, or a part made of separate components fixedly (i.e., non-moveably) connected together. Additionally, the words "a" and/or "an" as used in the claims mean "at least one" and the word "two" as used in the claims means "at least two". For the purpose of clarity, some technical material that is known in the related art has not been described in detail in order to avoid unnecessarily obscuring the disclosure.

The present invention relates to a latch assembly for storage compartment of an automobile (or automotive vehicle), provided to accommodate small articles and/or used for miscellaneous storage. An exemplary embodiment of the automotive storage compartment is generally represented in FIG. 1 of the accompanying drawings by reference numeral 1. In the exemplary embodiment of the present invention, the storage compartment of the automobile is in the form of a glove box (or glove compartment) 1 of an automobile (or automotive vehicle), provided to accommodate small articles. It will be appreciated that any other storage compartment in the automotive vehicle that includes an opening/closing member (i.e., closable lid) is within the scope of the present invention.

Typically, the glove box 1 is built into a dashboard (or instrument panel) (not shown) of an automobile, and is located over a front-seat passenger's footwell. The glove box 1 is conventionally used for miscellaneous storage. The glove box 1 comprises a hollow storage bin 2 (also known as a storage box or cassette), which is disposed inside the instrument panel, a lid 4 pivotally mounted to the storage bin 2, and a latch assembly 10 configured to for selectively secure the lid 4 to the storage bin 2. The storage bin 2, the lid 4, and the latch assembly 10 collectively define the glove box 1 of an automobile. The storage bin 2 is hollow so as to define a storage cavity 3 therein. The lid 4 is moveably (e.g., pivotally) attached to the storage bin 2 so as to move between an open position (shown in FIG. 1) allowing access to the storage cavity 3, and a closed position preventing access to the storage cavity 3. In other words, the lid 4 of the glove box 1 is configured to open and close an opening 6 to the storage cavity 3 in the storage bin 2 of the glove box 1. Typically, the lid 4 is rotatably (e.g., pivotally) coupled to the storage bin 2 of the glove box 1 via a hinge.

The lid 4 includes an outer panel 5*t* and an inner panel 5*i*. The outer panel 5*t* of the lid 4 forms a part of an outer surface of the instrument panel. The latch assembly 10 is mounted between the inner panel 5*i* and the outer panel 5*t* of the lid 4 as will be discussed in detail below. Also, the latch assembly 10 has a latched position (FIGS. 10 and 19), wherein respective parts of the latch assembly 10 removably engage the storage bin 2, and an unlatched position (FIGS. 13 and 14), wherein those parts of the latch assembly 10 are disengaged from the storage bin 2, such that the lid 4 is released from the storage bin 2 of the glove box 1.

The latch assembly 10 comprises at least one latch module $\mathbf{12}_1$ mounted to the lid 4, at least one striker (or anchor pocket) $\mathbf{14}_1$ associated with the at least one latch module $\mathbf{12}_1$ and mounted to the storage bin 2, an actuator assembly 16 for selectively moving the latch assembly 10 between the latched and unlatched positions, and at least one connecting rod $\mathbf{18}_1$ operatively connecting the actuator assembly 16 to the at least one latch module $\mathbf{12}_1$. According to the exemplary embodiment of the present invention, the actuator assembly 16 is mounted to the outer panel 5*t* of the lid 4.

Alternatively, the above described structure of the latch assembly 10 may be inverted. In other words, the at least one latch module $\mathbf{12}_1$ and the actuator assembly 16 may be mounted to the storage bin 2, while the at least one striker (or anchor pocket) $\mathbf{14}_1$ mounted to the pivotable lid 4.

The actuator assembly 16, according to the exemplary embodiment of the present invention, includes a handle 17 configured to being pulled (or, alternatively, pushed or rotated). Alternatively, the actuator assembly 16 may be actuated electrically, without a handle.

According to the exemplary embodiment of the present invention, the latch assembly 10 comprises two functionally identical latch modules: a first latch module $\mathbf{12}_1$ and a second (or additional) latch module $\mathbf{12}_2$ securely mounted to opposite (e.g. left and right) sides of the lid 4, and two functionally identical strikers (or anchor pockets): a first striker $\mathbf{14}_1$ and a second striker $\mathbf{14}_2$ fixed (i.e., non-moveably attached) to opposite (e.g. left and right) sides of the storage bin 2 of the glove box 1. In other words, the first striker $\mathbf{14}_1$ and the second striker $\mathbf{14}_2$ are integrated into the storage bin 2 of the glove box 1. Alternatively, the first striker $\mathbf{14}_1$ and the second striker $\mathbf{14}_2$ may be formed with the storage bin 2 as a single-piece part. According to the exemplary embodiment of the present invention, each of the first and second latch modules $\mathbf{12}_1$ and $\mathbf{12}_2$ is mounted to the lid 4 between the outer panel 5*t* and the inner panel 5*i* of the lid 4. Also, the latch assembly 10 comprises two connecting rods: a first connecting rod $\mathbf{18}_1$ and a second connecting rod $\mathbf{18}_2$.

The first striker $14_1$ is associated with the first latch module $12_1$, and the second striker $14_2$ is associated with the second latch module $12_2$. Thus, the exemplary embodiment of the latch assembly 10 comprises the first and second latch modules $12_1$ and $12_2$, the first and second strikers $14_1$ and $14_2$, the actuator assembly 16 for selectively moving the latch assembly 10 between the latched and unlatched positions, the second connecting rod $18_2$ operatively connecting the actuator assembly 16 to the first latch module $12_1$, a second connecting rod $18_2$ operatively connected to the second latch modules $12_2$, and a coupler 20 operatively connecting the first connecting rod $18_1$ to the second connecting rod $18_2$, as best shown in FIG. 1. In other words, the first connecting rod $18_1$ operatively couples the first latch module $12_1$ to the coupler 20, while the second connecting rod $18_2$ operatively couples the second latch module $12_2$ to the coupler 20.

The first and second latch modules $12_1$ and $12_2$ are structurally identical in the exemplary embodiment of the present invention. In view of the similarities and in the interest of simplicity, the following discussion will sometimes use a reference numeral 12 without a subscript numeral when generically referring to each of the first and second latch modules $12_1$ and $12_2$, rather than reciting all two reference numerals. Similarly, the first and second strikers $14_1$ and $14_2$ are structurally identical in the exemplary embodiment of the present invention. In view of the similarities and in the interest of simplicity, the following discussion will sometimes use a reference numeral 14 without a subscript numeral when generically referring to each of the first and second strikers $14_1$ and $14_2$, rather than reciting all two reference numerals. Similarly, the first and second connecting rods $18_1$ and $18_2$ are structurally similar in the exemplary embodiment of the present invention. In view of the similarities and in the interest of simplicity, the following discussion will sometimes use a reference numeral 18 without a subscript numeral when generically referring to each of the first and second connecting rods $18_1$ and $18_2$.

As illustrated in FIG. 1, an outward (or distal) end of each of the first and second connecting rods $18_1$ and $18_2$ is operatively connected to the latch modules 12, while an inward (or proximal) end of each of the first and second connecting rods $18_1$ and $18_2$ is operatively connected to the coupler 20 configured to provide a complementary reciprocating displacement of the first and second connecting rods $18_1$ and $18_2$. Thus, in response to actuation of the actuator assembly 16 by a user, the displacement of the first connecting rod $18_1$ is transmitted to the second connecting rod $18_2$ by the coupler 20 so that the second connecting rod $18_2$ is also displaced. Specifically, in response to actuation of the actuator assembly 16 by the user, the first connecting rod $18_1$ is retracted into the coupler 20, which, in turn, retracts the second connecting rod $18_2$ into the coupler 20. For example, the coupler 20 may include a gear mechanism rotation of which may pull both the first and second connecting rods $18_1$ and $18_2$ inward into a housing 21 of the coupler 20. A variety of couplers may be used with the present invention, such as disclosed in U.S. Patent Application Publication Nos. 2014/0152026 and 2018/0230720, which are incorporated herein by reference in their entirety.

Each of the first and second latch modules 12 includes a latch casing 22, an elongated latch bolt 24 extending through the latch casing 22, and a spring member 26. The latch casing 22 is fixed (i.e., non-moveably attached) to the lid 4. The latch casing 22 includes a hollow, unitary casing body 30 having a longitudinal casing axis $X_C$, as best shown in FIGS. 4-7. The hollow casing body 30 forms a cavity 32, which receives the latch bolt 24 therewithin. The casing body 30 of the latch casing 22 has a front (or first) opening $31_1$, and a rear (or second) opening $31_2$ coaxial with the front opening $31_1$ along the longitudinal casing axis $X_C$, such that the latch bolt 24 partially extends from the front and rear openings $31_1$ and $31_2$ through the casing body 30.

The casing body 30 of the latch casing 22 further includes a beveled control flange 34 at the front opening $31_1$ of the casing body 30. The beveled control flange 34 obliquely extends radially inwardly toward the longitudinal casing axis $X_C$ and partially forms the front opening $31_1$ in the casing body 30. The beveled control flange 34 has a beveled outer surface $35_1$, a beveled inner retain surface $35_2$, and an inner guide surface $35_3$ parallel to the longitudinal casing axis $X_C$. The beveled inner retain surface $35_2$ of the beveled control flange 34 obliquely extends radially inwardly toward the longitudinal casing axis $X_C$ and is juxtaposed to an inner rest surface 33 of the casing body 30 partially forming the cavity 32 in the casing body 30. The beveled control flange 34 of the casing body 30 has a central slot (or gap, or opening) 36. According to the exemplary embodiment of the present invention, the central slot 36 is formed centrally with respect to a transverse axis perpendicular to the longitudinal casing axis $X_C$ of the latch casing 22.

Figure 5:
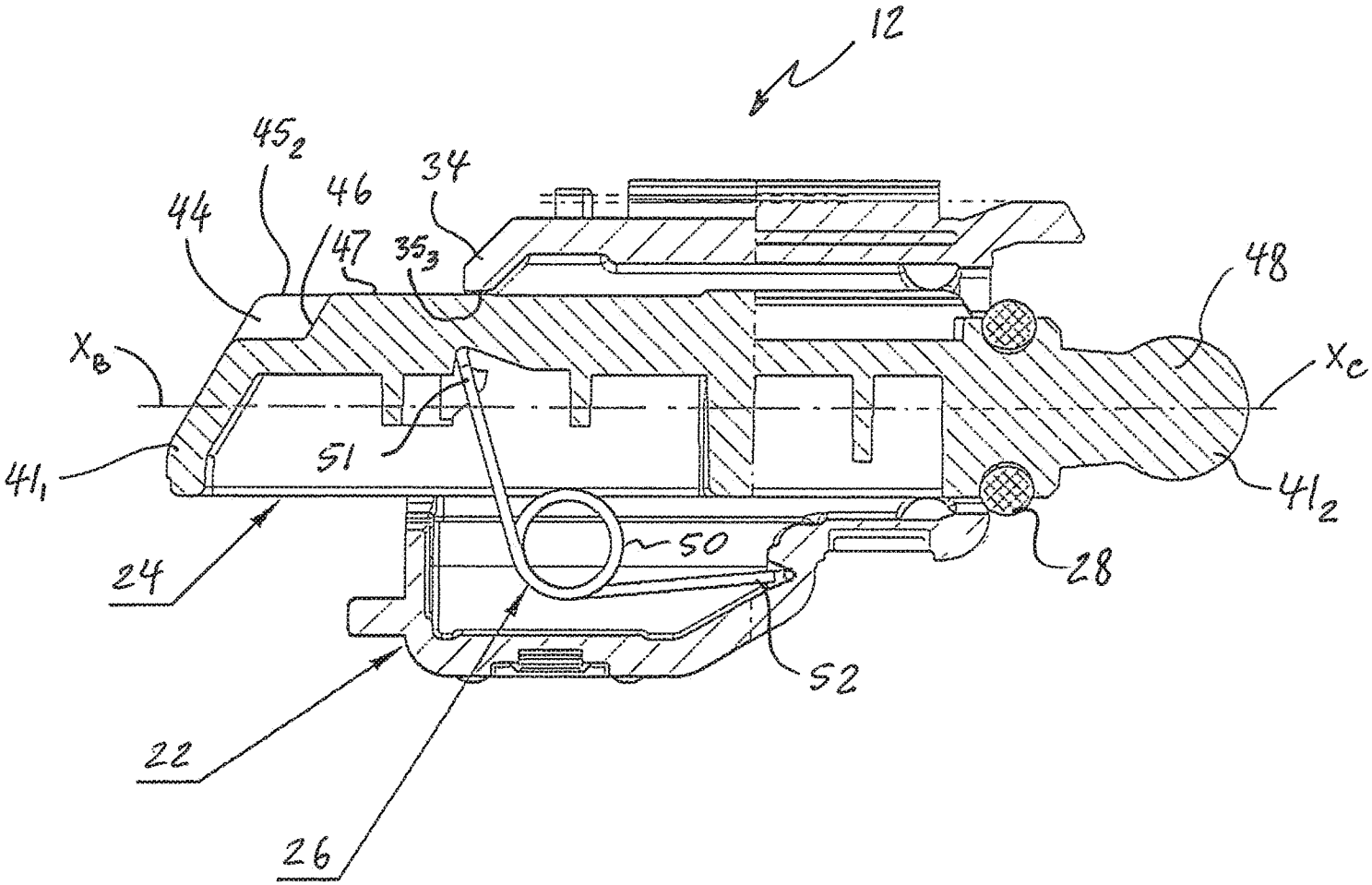
FIG. 5 is a sectional view of the latch module of FIG. 3.
Figure 6:
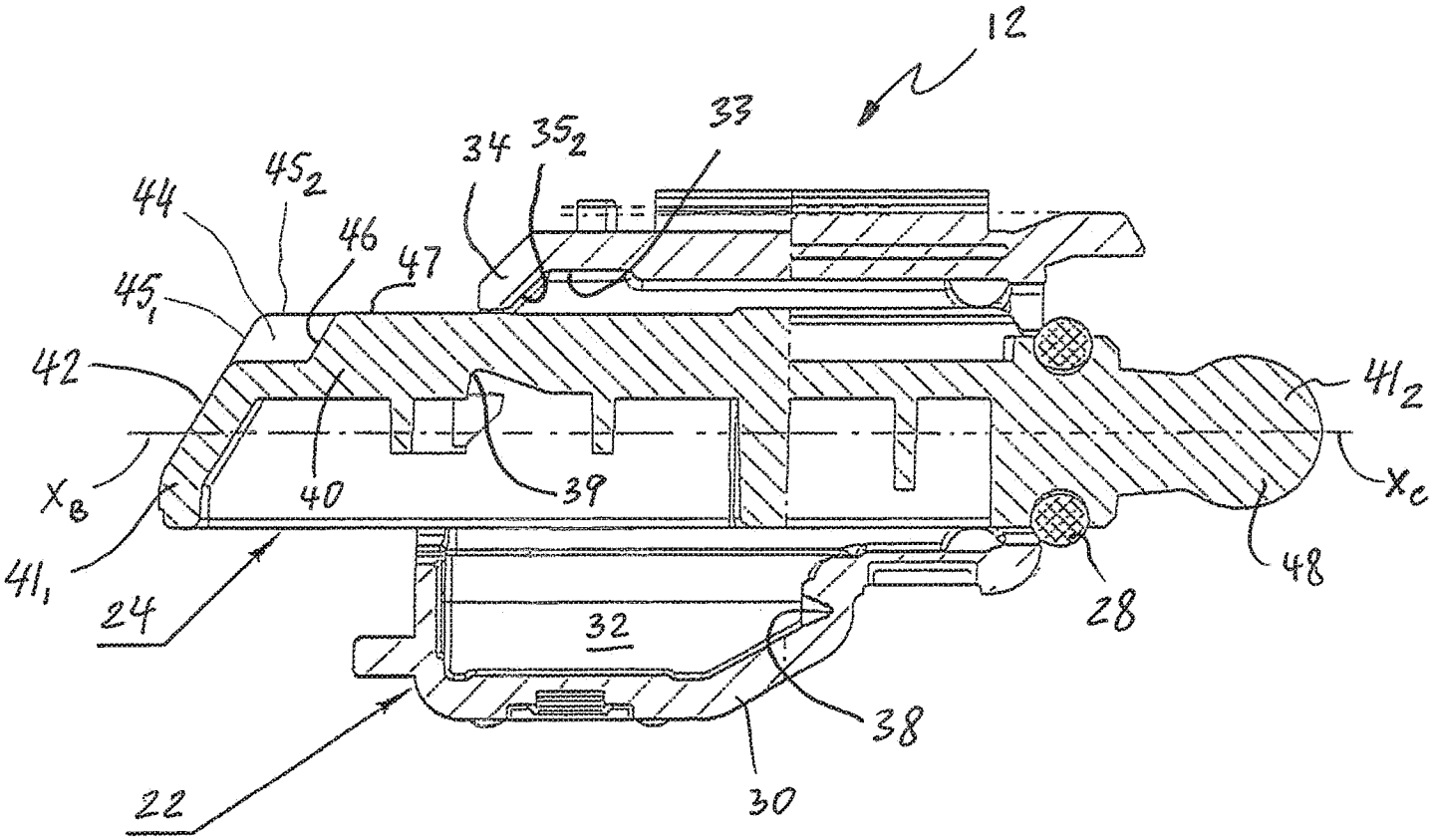
FIG. 6 is a sectional view of the latch module of FIG. 3 without a spring member.
Figure 7:
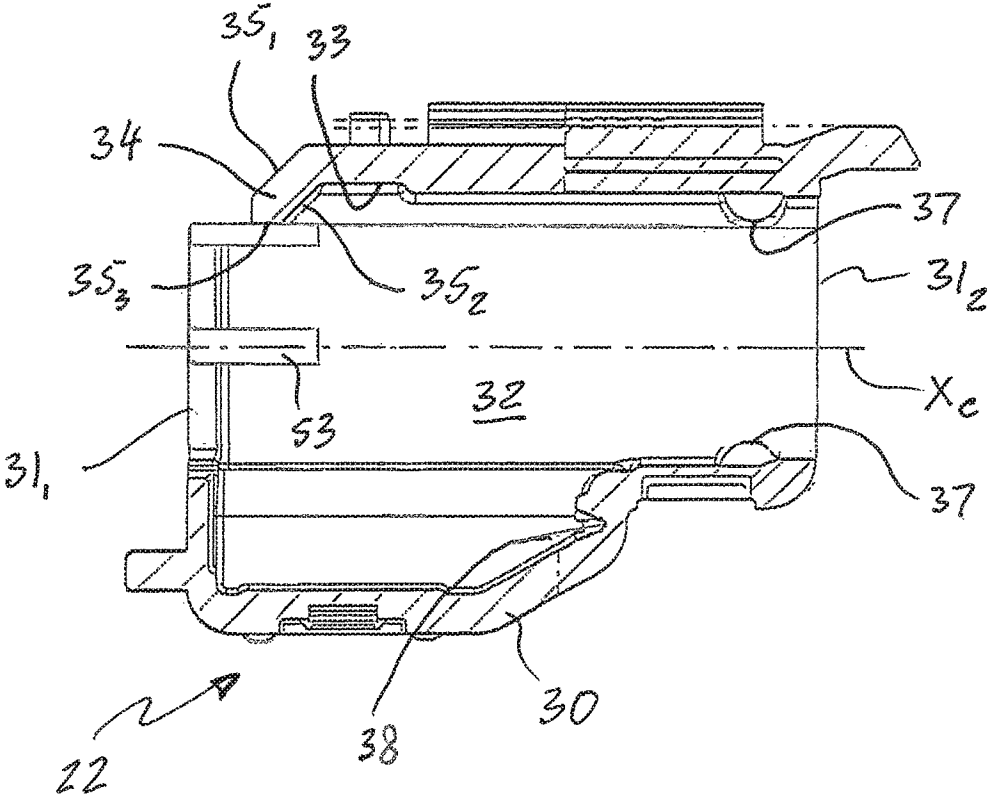
FIG. 7 is a sectional view of a latch casing of the latch module of FIG. 3.

The elongated latch bolt 24 includes an elongated unitary bolt body 40 having a longitudinal bolt axis $X_B$, as best shown in FIGS. 5 and 6. The bolt body 40 of the latch bolt 24 is axially moveable through and relative to the latch casing 22 along the longitudinal casing axis $X_C$ between an extended position (shown in FIGS. 5, 6 and 10) and a retracted position (shown in FIG. 14). Moreover, the bolt body 40 of the latch bolt 24 is axially moveable relative to the latch casing 22 coaxially with the longitudinal casing axis $X_C$, as shown in FIGS. 10-12 and 18-19. Additionally, the bolt body 40 of the latch bolt 24 is pivotable (i.e., rotatable) relative to the casing body 30 of the latch casing 22, as shown in FIGS. 13-17. The latch bolt 24 is in the extended position when the lid 4 of the glove box 1 is in the closed position, and in the retracted position when the lid 4 of the glove box 1 is in the open position. In other words, the latch bolt 24 is in the extended position when the latch assembly 10 is in the latched position, and in the retracted position when the latch assembly 10 is in the unlatched position.

The bolt body 40 of the latch bolt 24 has a free distal end $41_1$ adjacent to and at least partially extending from the front opening $31_1$ in the casing body 30, and a proximal end $41_2$ facing the coupler 20 and drivingly coupled to the connecting rod 18. In other words, the bolt body 40 extends along the longitudinal bolt axis $X_B$ between the free distal end $41_1$ and the proximal end $41_2$. The free distal end $41_1$ of the bolt body 40 of latch bolt 24 has a flat, beveled contact surface 42, and a contact rib 44 complementary to the central slot 36 in the latch casing 22 for permitting axial movement of the latch bolt 24 with respect to the latch casing 22 along the longitudinal casing axis $X_C$ of the latch casing 22. Specifically, the contact rib 44 of the latch bolt 24 extends into the central slot 36 of the latch casing 22 when the latch bolt 24 pivots relative to the casing body 30 of the latch casing 22. According to the exemplary embodiment of the present invention, the contact rib 44 is formed centrally with respect to a transverse axis perpendicular to the longitudinal bolt axis $X_B$ of the bolt body 40.

The casing body 30 of the latch casing 22 further includes at least one pair of longitudinal ribs 53 formed adjacent to the front opening $31_1$ in the casing body 30, and a pair of transversely opposite (in the direction perpendicular to the longitudinal casing axis $X_C$) semi-cylindrical bolt supports 37 formed adjacent to the rear opening $\mathbf{31}_2$ in the casing body 30. The longitudinal ribs 53 continuously engage the bolt body 40 so as to allow the linear displacement of the bolt body 40 relative to the casing body 30, while the bolt supports 37 continuously engage the bolt body 40 so as to support the bolt body 40 and allow the linear and pivotal displacement of the bolt body 40 relative to the casing body 30.

The contact rib 44 of the bolt body 40 has a flat, beveled contact surface $\mathbf{45}_1$ and a flat strike surface $\mathbf{45}_2$ configured to selectively engage the striker 14. The beveled contact surface $\mathbf{45}_1$ of the contact rib 44 of the bolt body 40 is coplanar with the contact surface 42 of the bolt body 40 of latch bolt 24. Moreover, according to the exemplary embodiment of the present invention, the strike surface $\mathbf{45}_2$ of the bolt body 40 is parallel to the longitudinal bolt axis $X_B$. The elongated bolt body 40 of the latch bolt 24 further includes at least one, preferably two beveled outer retain surfaces 46 separated by the contact rib 44 and configured to selectively engage the beveled inner retain surface $\mathbf{35}_2$ of the beveled control flange 34. As best shown in FIGS. 3-6, the at least one beveled outer retain surface 46 is disposed between the free distal end $\mathbf{41}_1$ and the proximal end $\mathbf{41}_2$ of the bolt body 40 of the elongated latch bolt 24. The beveled outer retain surfaces 46 of the elongated bolt body 40 are configured to cooperate with the beveled inner retain surface $\mathbf{35}_2$ of the beveled control flange 34 of the casing body 30. Moreover, the elongated bolt body 40 of the latch bolt 24 also includes at least one, preferably two outer guide surfaces 47 separated by the contact rib 44 and configured to selectively engage the inner guide surface $\mathbf{35}_3$ of the beveled control flange 34. In other words, the one or more guide surfaces 47 of the elongated bolt body 40 are juxtaposed (or adjacent) to the strike surface $\mathbf{45}_2$ of the bolt body 40 and to the one or more beveled outer retain surfaces 46 of the elongated bolt body 40.

Figure 2:
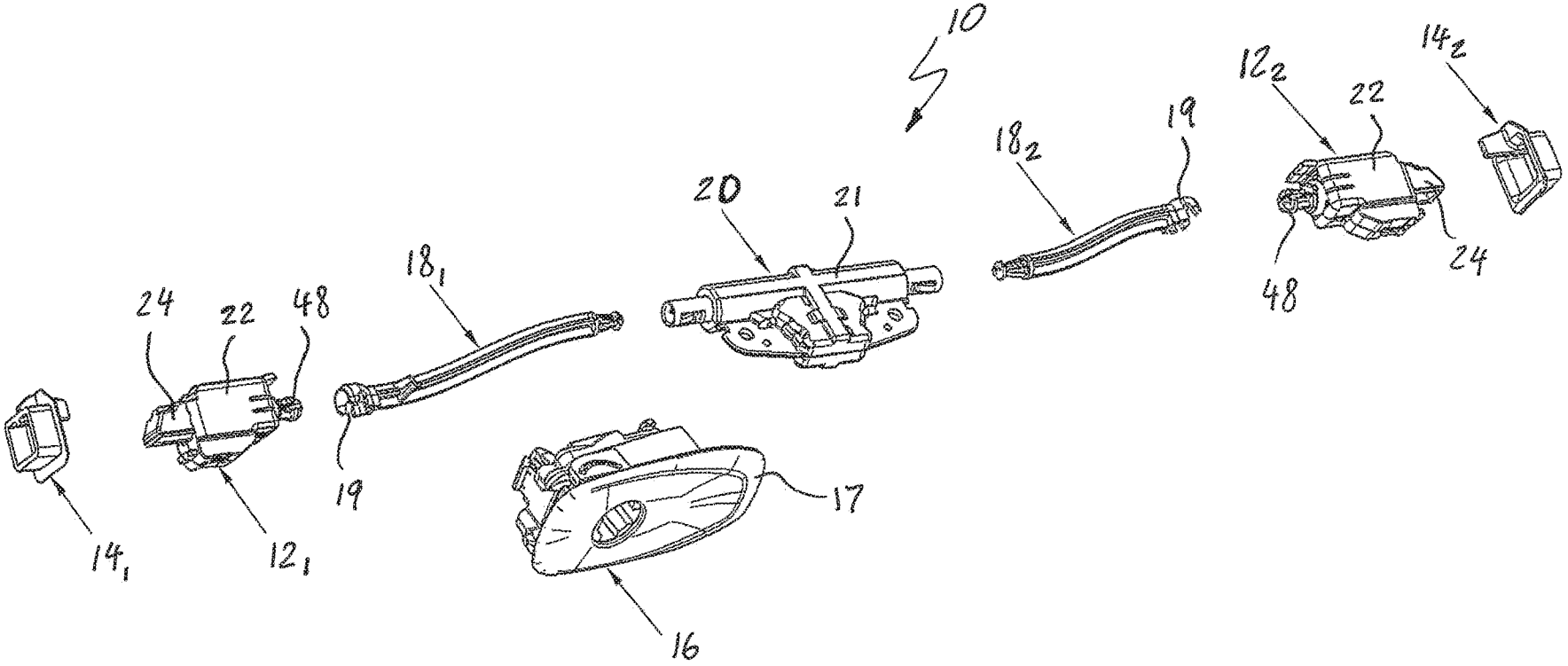
FIG. 2 is an exploded perspective view of a latch assembly according to the exemplary embodiment of the present invention.
Figure 3:
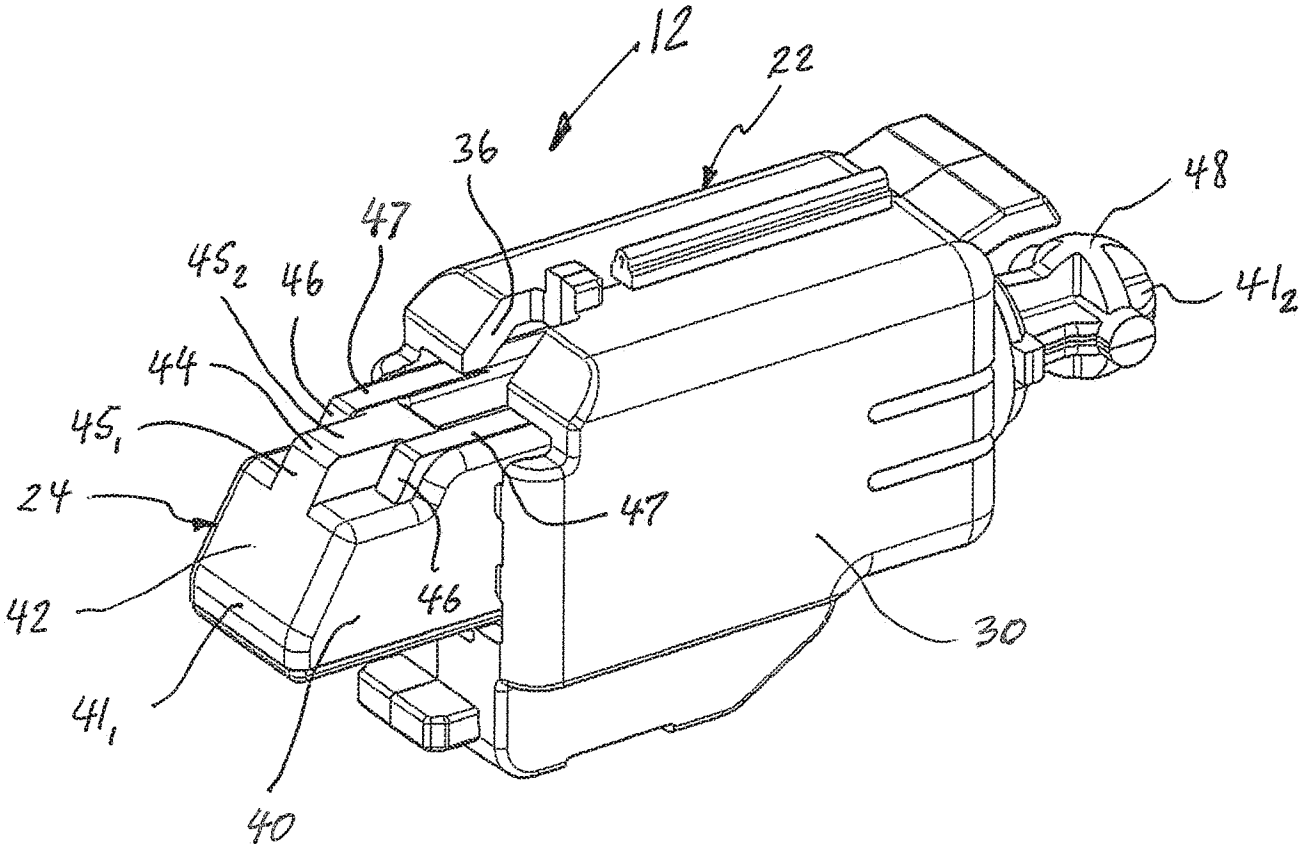
FIG. 3 is a perspective view of a latch module according to the exemplary embodiment of the present invention.
Figure 4:
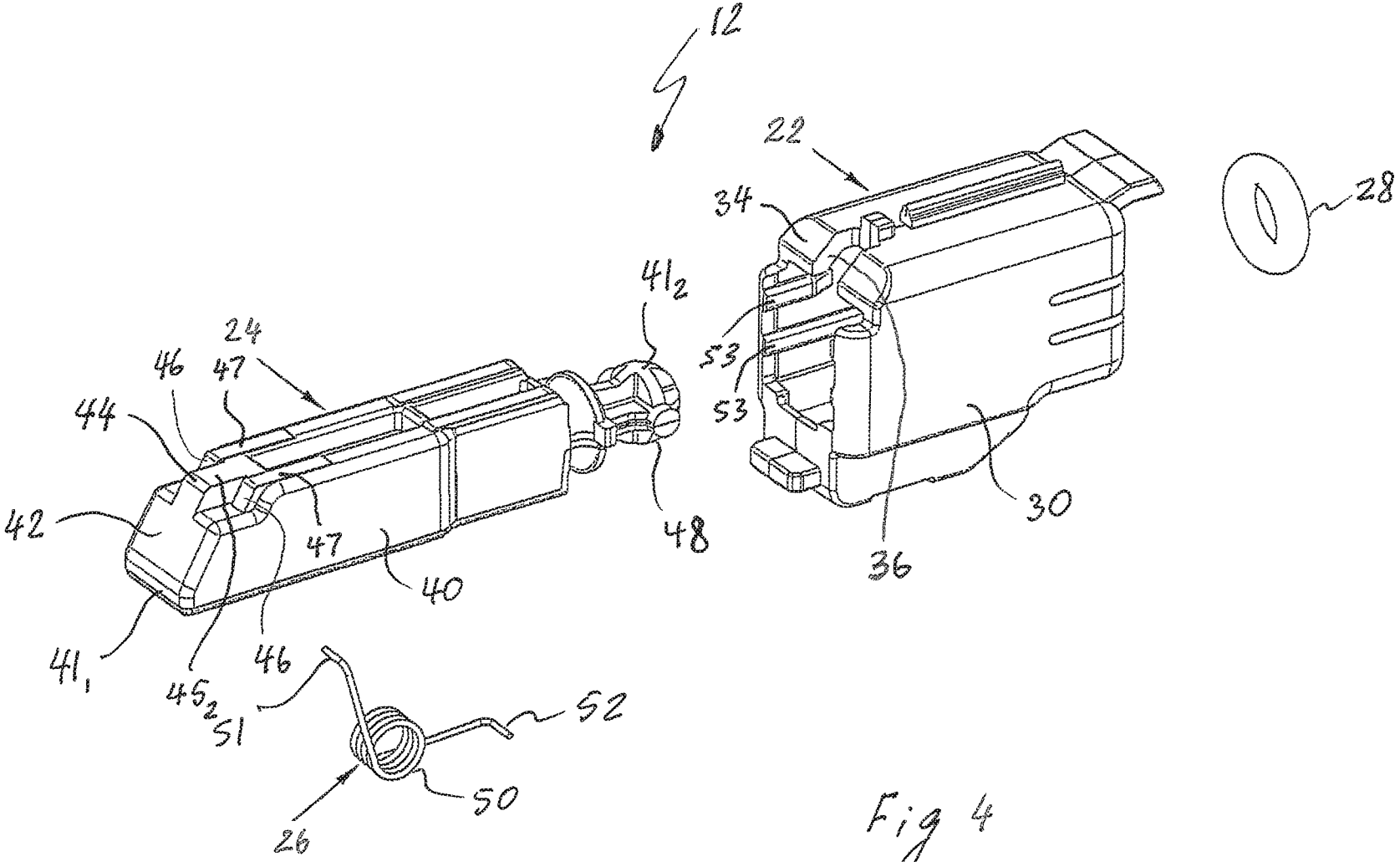
FIG. 4 is an exploded perspective view of the latch module of FIG. 3.

Furthermore, the bolt body 40 of the latch bolt 24 is provided with a coupling ball member 48 drivingly connected to one of the distal ends of the connecting rod 18 such that the axial movement of the latch bolt 24 of the latch modules 12 is transmitted to the connecting rod 18, and vice versa. Specifically, according to the exemplary embodiment of the present invention, the outward end of the connecting rod 18 is provided with a ball socket 19 (best shown in FIG. 2) configured to receive the coupling ball member 48 of the bolt body 40 so as to form a ball-and-socket connection 49 for pivotally coupling the latch bolt 24 to the connecting rod 18, as shown in FIG. 1.

According to the exemplary embodiment of the present invention, the spring member 26 is in the form of a torsion spring. A torsion spring is known in the art as a spring that works by torsion or twisting, such that when the torsion spring is twisted, it exerts a torque in the opposite direction, proportional to the amount (angle) it is twisted. The torsion spring 26 includes a spring coil 50, and two radially projecting spring ends: a bolt spring end 51 engaging the latch bolt 24, and a casing spring end 52 engaging the latch casing 22. The casing body 30 further includes a spring end positioning slot 38 configured to securely receive therein the casing spring end 52 of the torsion spring 26. Similarly, the bolt body 40 includes a spring end positioning slot 39 configured to securely receive therein the bolt spring end 51 of the torsion spring 26.

Moreover, as illustrated in FIG. 5, the torsion spring 26 biases the latch bolt 24 in the direction from the rear opening $\mathbf{31}_2$ to the front opening $\mathbf{31}_1$ of the latch casing 22. In other words, the torsion spring 26 biases the free distal end $\mathbf{41}_1$ of the bolt body 40 away from the latch casing 22. Furthermore, the torsion spring 26 biases the bolt body 40 upwardly toward the beveled control flange 34 of the latch casing 22, as illustrated in FIGS. 13-17.

The latch bolt 24 further includes a damping buffer 28 mounted to the proximal end $\mathbf{41}_2$ of the bolt body 40 of the latch bolt 24 for limiting axial movement of the latch bolt 24 relative to the latch casing 22 in the direction from the rear opening $\mathbf{31}_2$ to the front opening $\mathbf{31}_1$ of the latch casing 22, as best shown in FIG. 5. According to the exemplary embodiment of the present invention, the damping buffer 28 is in the form of an O-ring made of an elastomeric material. The O-ring 28 is configured to engage the casing body 30 of the latch casing 22 at the rear opening $\mathbf{31}_2$ thereof when the latch bolt 24 axially moves in the direction from the rear opening $\mathbf{31}_2$ to the front opening $\mathbf{31}_1$ of the latch casing 22, thus limiting axial movement of the latch bolt 24 relative to the latch casing 22. In other words, in the extended position of the latch bolt 24, the damping buffer 28 engages the casing body 30 of the latch casing 22 at the rear opening $\mathbf{31}_2$ thereof.

Figure 8:
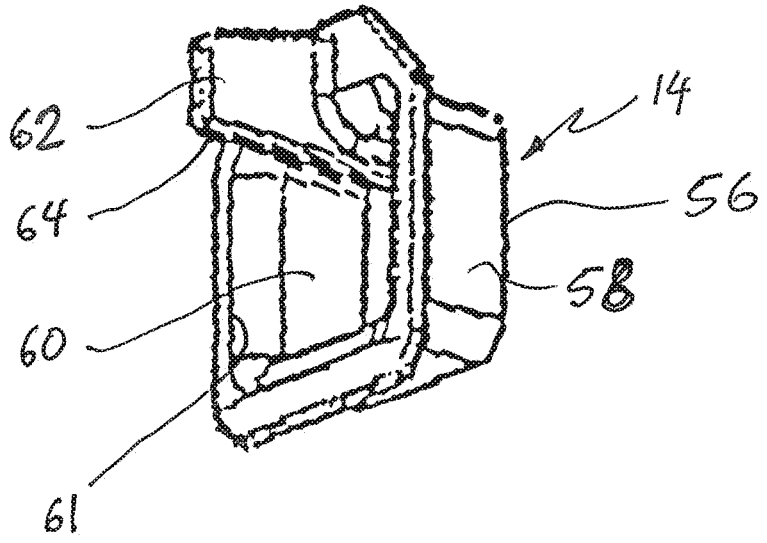
FIG. 8 is a perspective view of a striker according to the exemplary embodiment of the present invention.
Figure 9:
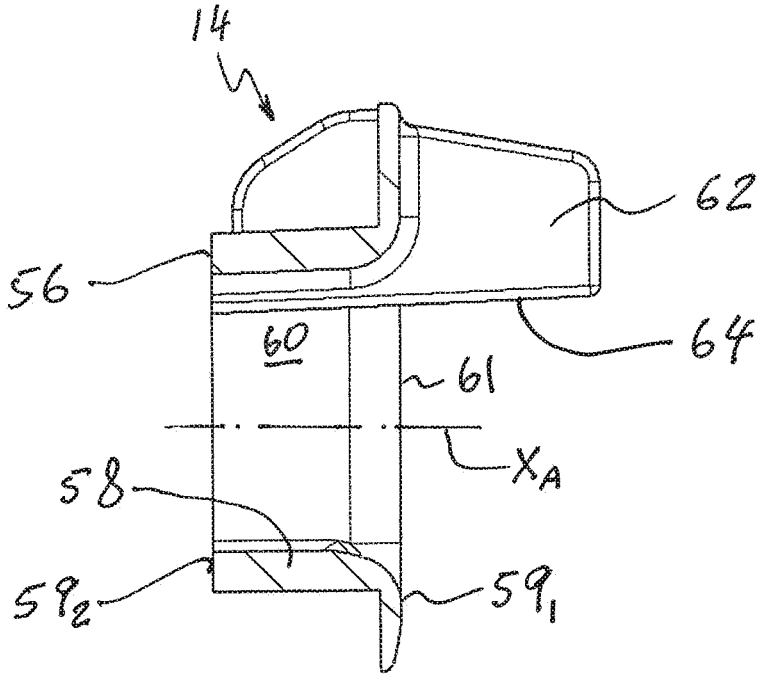
FIG. 9 is sectional view of the striker of FIG. 8.

The striker 14 includes a hollow, unitary striker body 56 having a longitudinal striker axis $X_A$, as best shown in FIGS. 8 and 9. The hollow striker body 56 includes a continuous wall 58 having a front end $\mathbf{59}_1$ and a rear end $\mathbf{59}_2$, and a strike member 62. The strike member 62 axially extends from the front end $\mathbf{59}_1$ of the continuous wall 58 of the striker body 56 toward the latch module 12. The continuous wall 58 of the striker body 56 forms a latch pocket 60 configured for receiving the free distal end $\mathbf{41}_1$ of the latch bolt 24 therewithin through a latch bolt opening 61 formed at the front end $\mathbf{59}_1$ of the continuous wall 58 of the striker body 56. According to the exemplary embodiment of the present invention, the striker body 56 has two opposite openings, as illustrated in FIGS. 8 and 9. Alternatively, the striker body 56 may have only one opening 61 at the front end $\mathbf{59}_1$ of the continuous wall 58 of the striker body 56. The striker body 56 is mounted to the storage bin 2 of the glove box 1 so that the strike member 62 extends toward (or faces) the cavity 3 in the storage bin 2 and the latch module 12.

According to the exemplary embodiment of the present invention, the strike member 62 is in the form of a rib extending parallel to the longitudinal striker axis $X_A$, as best shown in FIGS. 8 and 9. Further according to the exemplary embodiment of the present invention, the strike member 62 is formed centrally with respect to a transverse axis perpendicular to the longitudinal striker axis $X_A$ of the striker body 56. The strike member 62 has an actuator surface 64 along and parallel to the longitudinal striker axis $X_A$ of the striker body 56.

Operation of the latch assembly 10 according to the exemplary embodiment of the present invention is described hereafter. FIGS. 10-14 illustrate an opening (or unlatching) sequence of the latch assembly 10 of the glove box 1.

Figure 10:
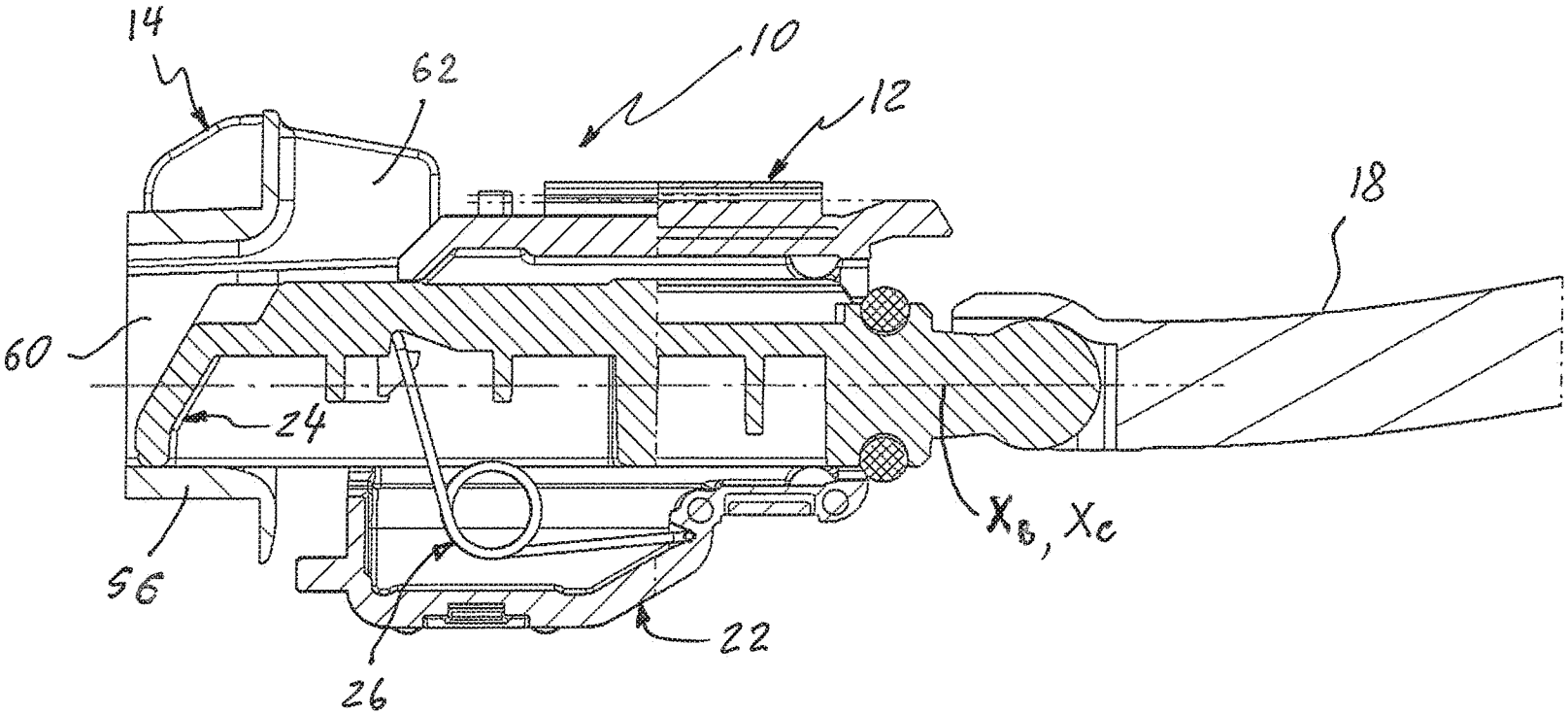
FIGS. 10-14 illustrate an unlatching sequence of the latch assembly according to the exemplary embodiment of the present invention.

Referring first to FIG. 10, the lid 4 of the glove box 1 is in the closed position. Accordingly, the latch bolt 24 of each of the first and second latch modules $\mathbf{12}_1$ and $\mathbf{12}_2$ is in the extended position, and the damping buffer 28 engages the casing body 30 of the latch casing 22 at the rear opening $\mathbf{31}_2$ thereof. In this position, the latch bolt 24 of each of the first and second latch modules $\mathbf{12}_1$ and $\mathbf{12}_2$ is disposed in the latch pocket 60 of the corresponding first and second striker $\mathbf{14}_1$ and $\mathbf{14}_2$, thus fully engaging the first and second strikers $\mathbf{14}_1$ and $\mathbf{14}_2$, and preventing the lid 4 of the glove box 1 from opening, i.e., from moving to the open position. The latch bolt 24 of each of the first and second latch modules $\mathbf{12}_1$ and $\mathbf{12}_2$ is biased in the extended position by the torsion spring 26.

In operation, upon actuation of the actuator assembly 16, i.e., when the handle 17 is pulled away from the lid 4 of the glove box 1 in the closed position, the actuator assembly 16 displaces both of the first and second connecting rods $\mathbf{18}_1$ and $\mathbf{18}_2$ simultaneously in the direction away from the latch casing 22 of each of the corresponding first and second latch modules $\mathbf{12}_1$ and $\mathbf{12}_2$, and toward the coupler 20. As a result, the first and second connecting rods $\mathbf{18}_1$ and $\mathbf{18}_2$ simultaneously move the latch bolt 24 of the corresponding first and second latch modules $\mathbf{12}_1$ and $\mathbf{12}_2$ linearly toward the retracted position thereof against the biasing force of the torsion spring 26. Synchronization between the first and second latch modules $\mathbf{12}_1$ and $\mathbf{12}_2$ is achieved via the coupler 20 and the first and second connecting rods $\mathbf{18}_1$ and $\mathbf{18}_2$. The coupler 20 does not require spring loaded elements. It only synchronizes movement of the latching bolts 24 of the first and second latch modules $\mathbf{12}_1$ and $\mathbf{12}_2$. Actuation of the first and second latch modules $\mathbf{12}_1$ and $\mathbf{12}_2$ is realized by the handle 17 that can be applied to one of the connecting rods 18 or through the coupler 20.

As noted above, alternatively, the actuator assembly 16 may be actuated electrically, without a handle, so that both of the first and second connecting rods $\mathbf{18}_1$ and $\mathbf{18}_2$ simultaneously displaced by a solenoid or an electric motor upon pressing an actuator button (not shown).

Figure 11:
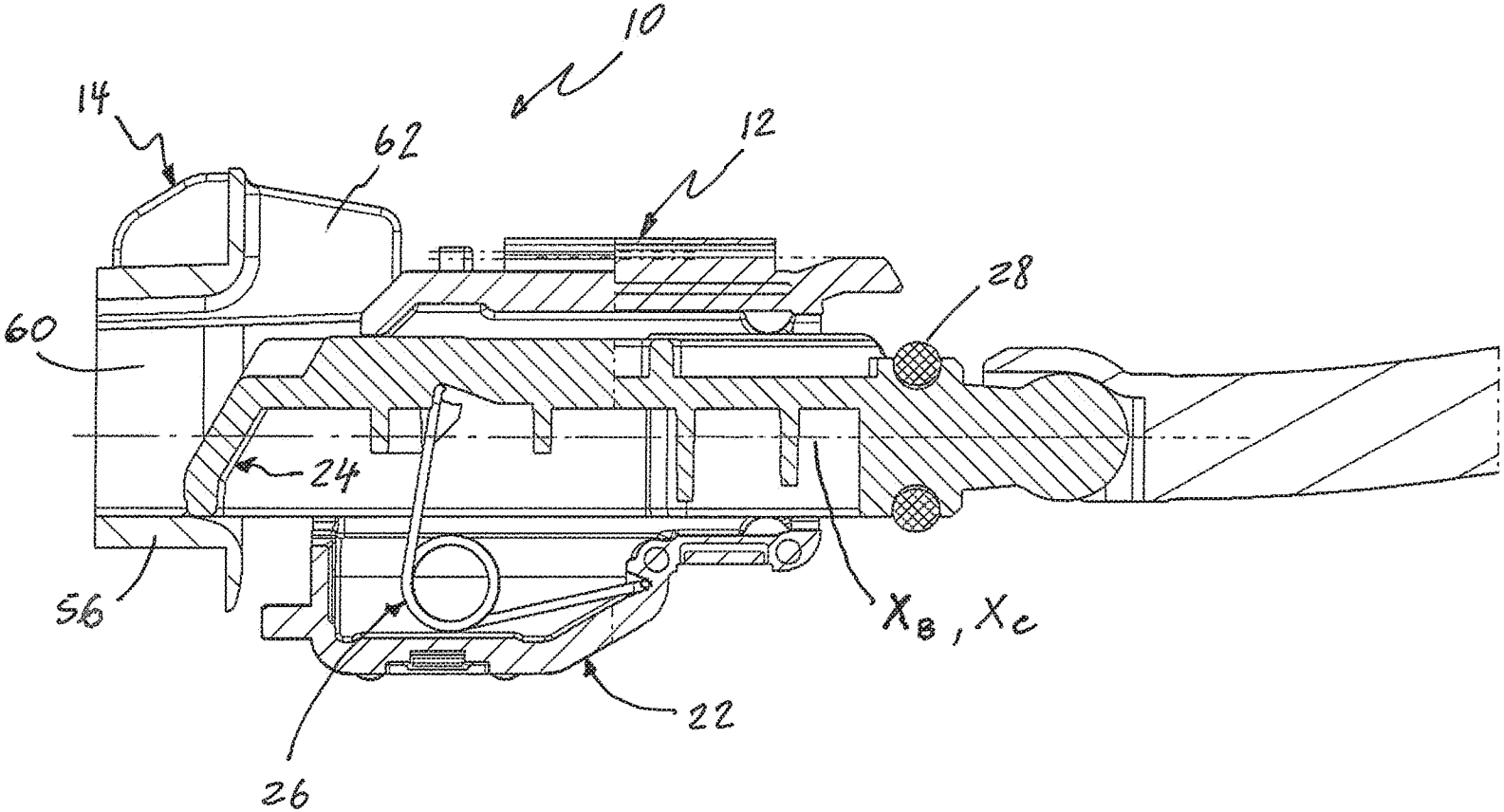

Initially, as illustrated in FIG. 11, the latch bolt 24 of each of the first and second latch modules $\mathbf{12}_1$ and $\mathbf{12}_2$ is axially displaced relative to the casing body 30 coaxially with the longitudinal casing axis $X_C$ axially away from the corresponding first or second striker $\mathbf{14}_1$ and $\mathbf{14}_2$ against the biasing force of the torsion spring 26. The latch bolt 24 axially slides relative to the casing body 30 coaxially with the longitudinal casing axis $X_C$ by slidingly engaging the outer guide surfaces 47 of the latch bolt 24 with the inner guide surface $\mathbf{35}_3$ of the casing body 30. The damping buffer 28 is axially spaced from the casing body 30 of the latch casing 22. The latch bolt 24 is partially disposed in the latch pocket 60 of the striker 14.

Figure 12:
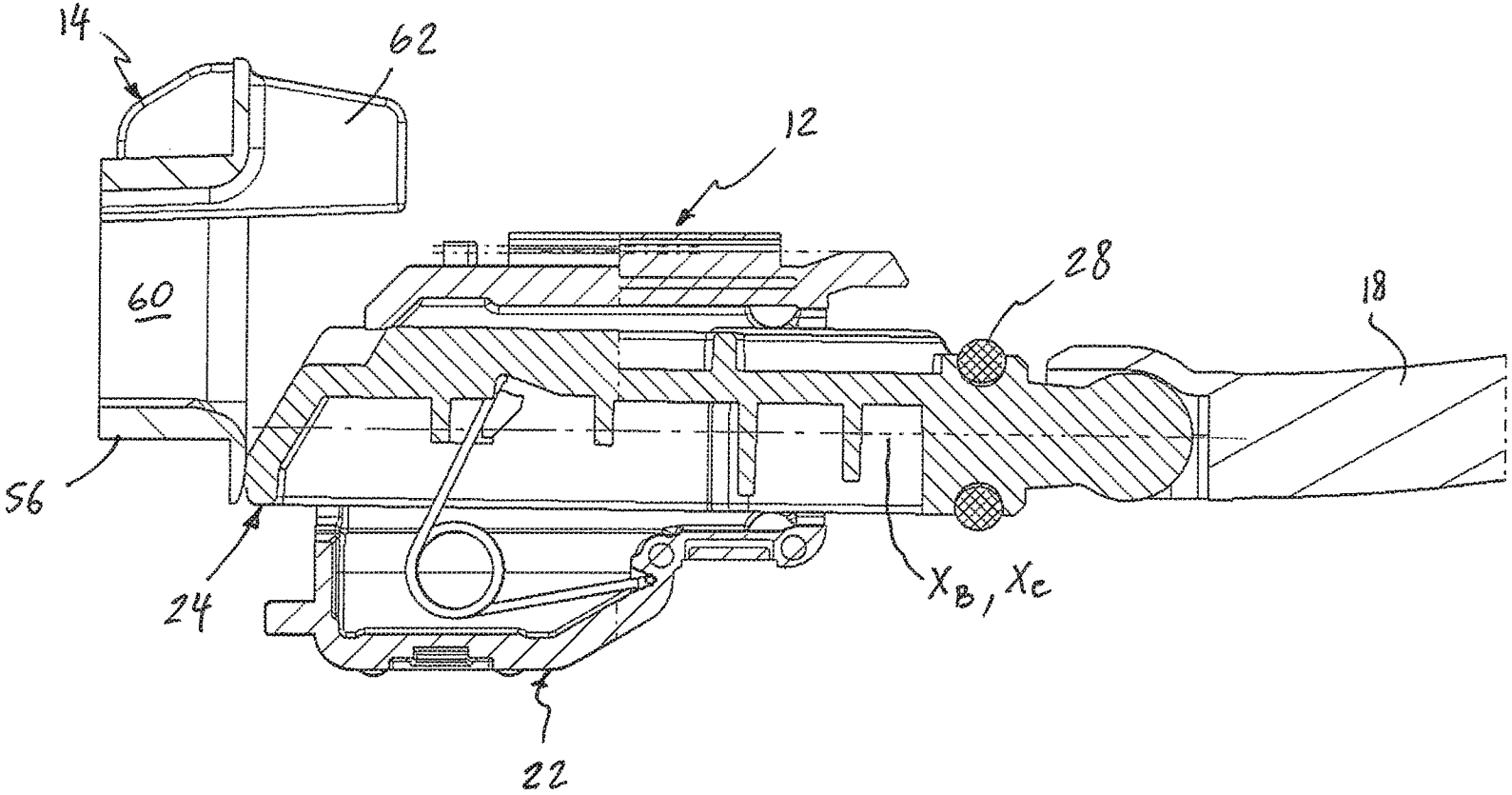

As illustrated in FIG. 12, upon further pulling of the handle 17, and, as a result, further displacement of the latch bolt 24 of each of the first and second latch modules $\mathbf{12}_1$ and $\mathbf{12}_2$ relative to the casing body 30 coaxially with the longitudinal casing axis $X_C$ and axially away from the corresponding first or second striker $\mathbf{14}_1$ and $\mathbf{14}_2$ against the biasing force of the torsion spring 26, the latch bolt 24 is disengaged from the striker 14. In other words, the latch bolt 24 is out of the latch pocket 60 of the striker body 56 of the striker 14, thus allowing the lid 4 to pivot toward the open position. Thus, when the inward displacement of the latch bolt 24 is sufficient to effectively disengage the bolt body 40 from the front end $\mathbf{59}_1$ of the striker 14, the latch bolt 24 fully escapes the latch pocket 60 (i.e., the front end $\mathbf{59}_1$ of the striker body 56) and permits opening of the lid 4 of the glove box 1, as shown in FIG. 12. The outer guide surfaces 47 of the latch bolt 24 still partially slidingly engage the inner guide surface $\mathbf{35}_3$ of the casing body 30.

Figure 13:
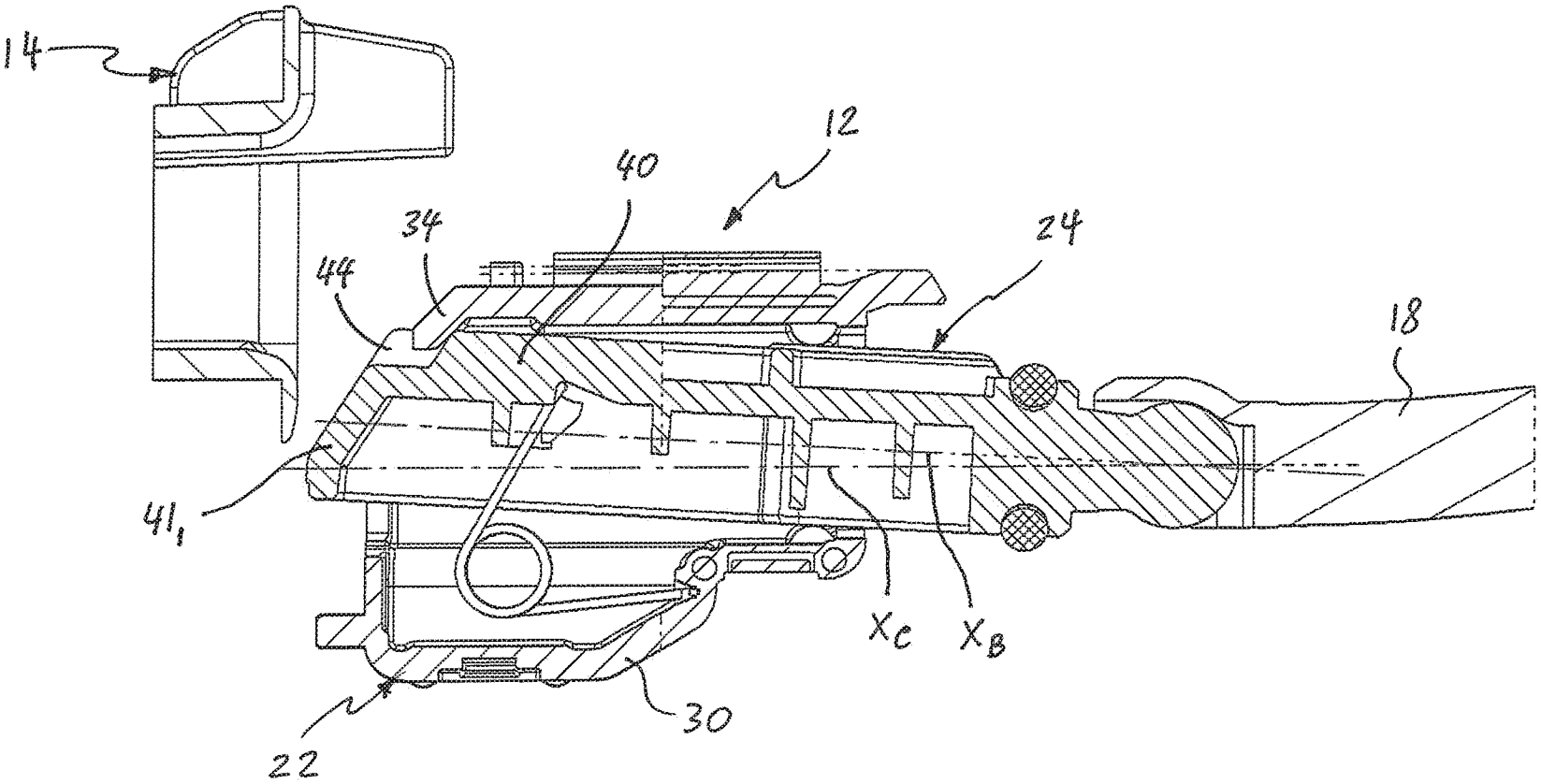

As illustrated in FIG. 13, upon further displacement of the latch bolt 24 of each of the first and second latch modules $\mathbf{12}_1$ and $\mathbf{12}_2$ relative to the casing body 30 coaxially with the longitudinal casing axis $X_C$, the bolt body 40 retracts into the cavity 32 of the casing body 30 so that the outer guide surfaces 47 of the latch bolt 24 is disengaged from the inner guide surface $\mathbf{35}_3$ of the casing body 30. Consequently, the bolt body 40 pivots upward over the bolt supports 37 of the casing body 30. The pivotal (or rotational) movement of the bolt body 40 is imparted by the biasing force of the torsion spring 26 so that the beveled outer retain surfaces 46 of the bolt body 40 engage the beveled inner retain surface $\mathbf{35}_2$ of the beveled control flange 34 of the casing body 30. In this position the longitudinal bolt axis $X_B$ of the bolt body 40 is oblique (i.e., neither perpendicular nor parallel) relative to the longitudinal casing axis $X_C$ of the casing body 30. Also, the contact rib 44 of the bolt body 40 enters the central slot 36 of the beveled control flange 34 of the casing body 30, so that the consequent axial movement of the bolt body 40 is guided by the central slot 36.

Figure 14:
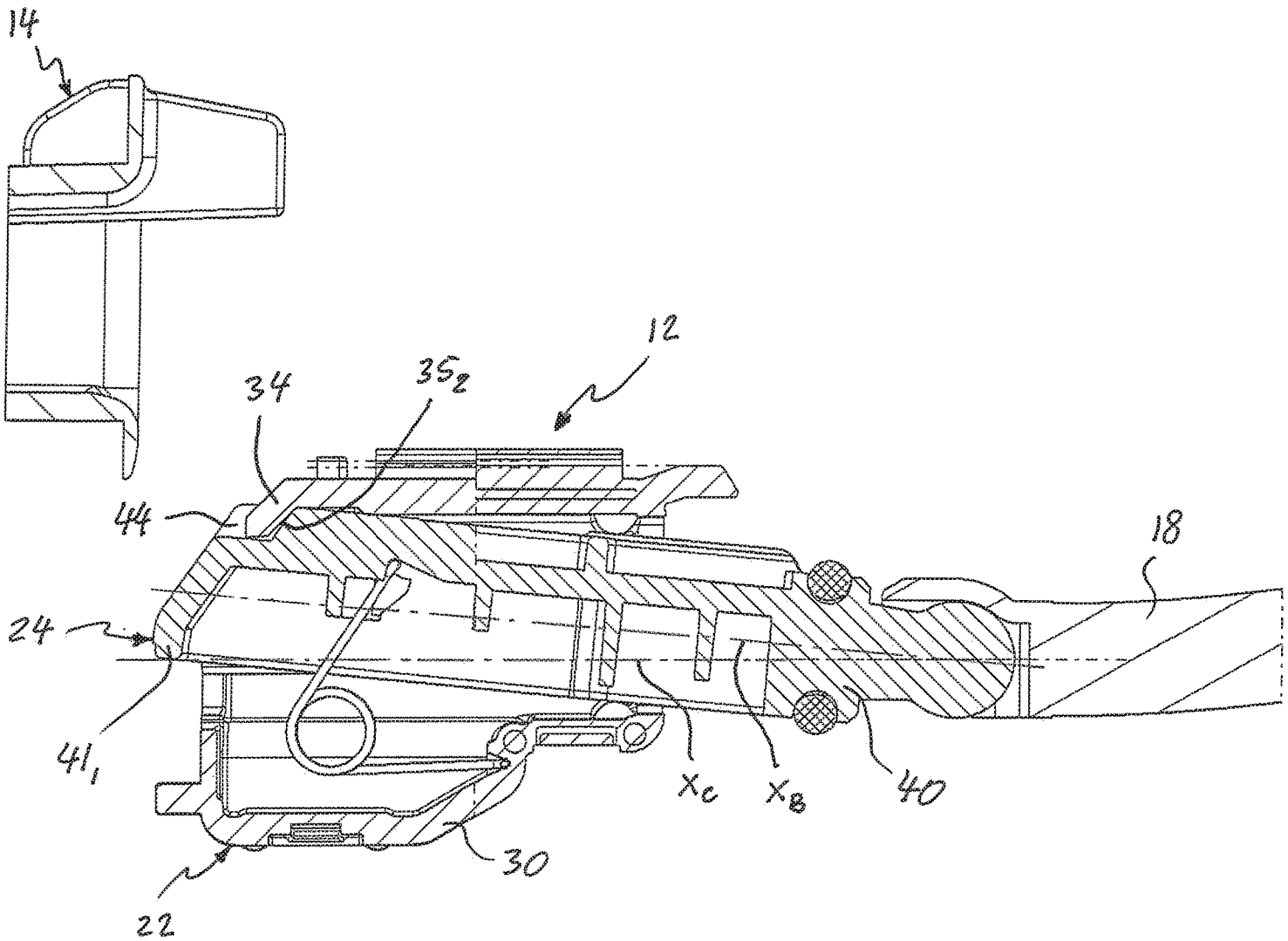
Figure 15:
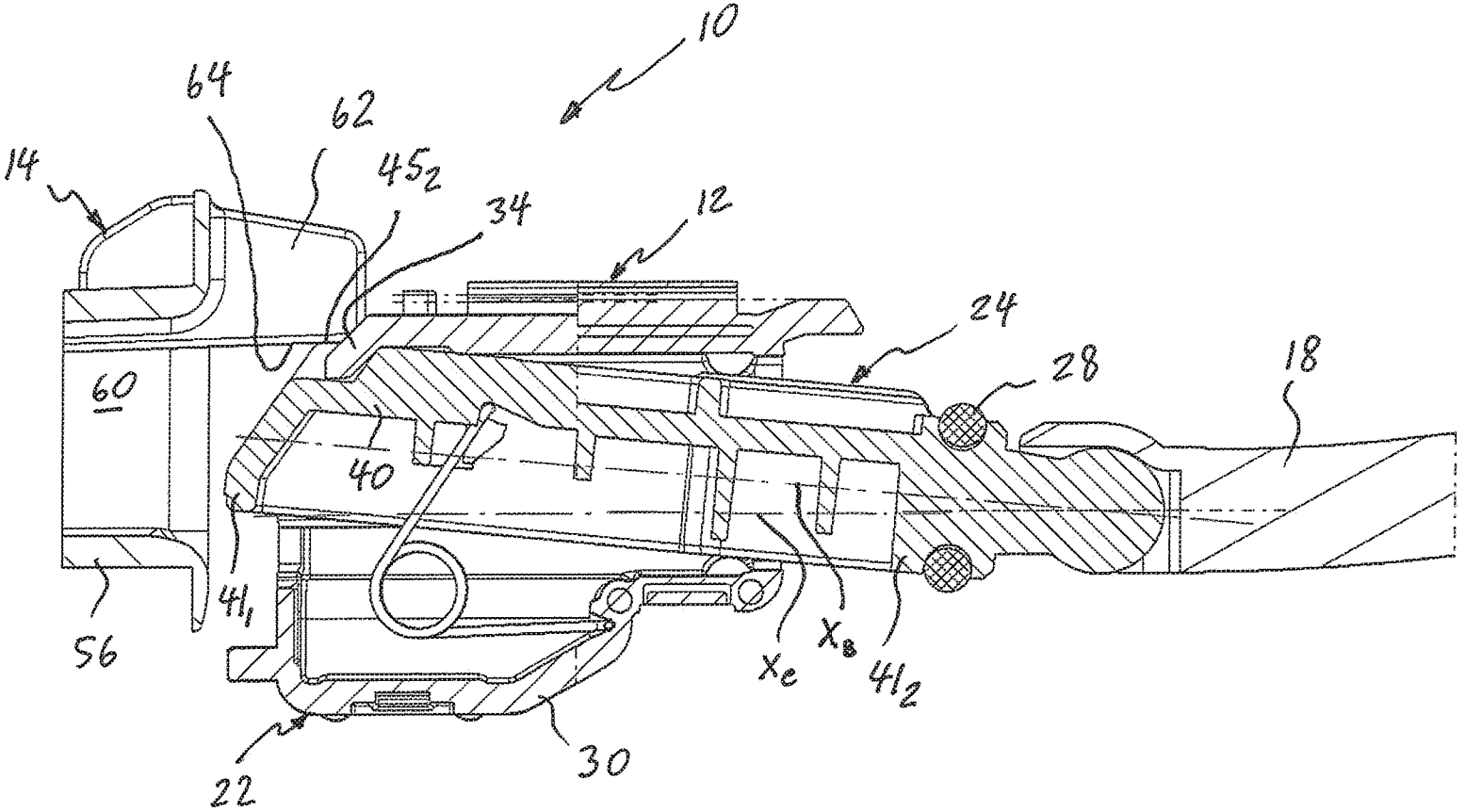
FIGS. 15-19 illustrate a latching sequence of the latch assembly according to the exemplary embodiment of the present invention.

As illustrated in FIG. 14, upon further displacement of the latch bolt 24 of each of the first and second latch modules $\mathbf{12}_1$ and $\mathbf{12}_2$ relative to the casing body 30, the torsion spring 26 pushes the bolt body 40 further upward into the cavity 32 of the casing body 30 until the outer guide surfaces 47 of the bolt body 40 engage the inner rest surface 33 of the casing body 30, thus placing the latch bolt 24 in the retracted position. In this position the torsion spring 26 pushes the beveled outer retain surfaces 46 of the bolt body 40 firmly axially against the beveled inner retain surface $\mathbf{35}_2$ of the casing body 30 and holds in the retracted position, thus preventing movement of the free distal end $\mathbf{41}_1$ of the bolt body 40 out of the casing body 30 of the latch casing 22. Moreover, the longitudinal bolt axis $X_B$ of the bolt body 40 is oblique with respect to the longitudinal casing axis $X_C$ of the casing body 30, as shown in FIG. 14. Also, the contact rib 44 of the bolt body 40 is disposed in the central slot 36 of the beveled control flange 34 of the casing body 30. Therefore, during the unlatching of the latch assembly 10 of the glove box 1 the latching bolts 24 is pulled into the latch casing 22 and is retained (or held) in the retracted position upon release of the handle 17 of the lid 4. In the retracted position the latching bolts 24 is fully retracted and retained in the latch casing 22 by the biasing force of the torsion spring 26 of the latch module 12. Moreover, in the extended position of the latch bolt 24, the longitudinal bolt axis $X_B$ of the latch bolt 24 is coaxial with the longitudinal casing axis $X_C$ of the latch casing 22 (as illustrated in FIG. 10), while in the retracted position of the latch bolt 24, the longitudinal bolt axis $X_B$ of the latch bolt 24 is oblique with respect to the longitudinal casing axis $X_C$ of the latch casing 22 (as illustrated in FIG. 14).

FIGS. 15-19 illustrate a closing (or latching) sequence of the latch assembly 10 of the glove box 1. Referring first to FIG. 14, the lid 4 of the glove box 1 is in the open position. Accordingly, the latch bolt 24 of each of the first and second latch modules $\mathbf{12}_1$ and $\mathbf{12}_2$ is in the retracted position. Initially, the lid 4 of the glove box 1 with the latch module 12 is moved by the user toward the closed position, i.e., toward the storage bin 2 and the striker 14. In the position illustrated in FIG. 15, the latching bolts 24 is in the retracted position, and the strike surface $\mathbf{45}_2$ of the contact rib 44 of the bolt body 40 engages the actuator surface 64 of the strike member 62 of the striker 14.

Figure 16:
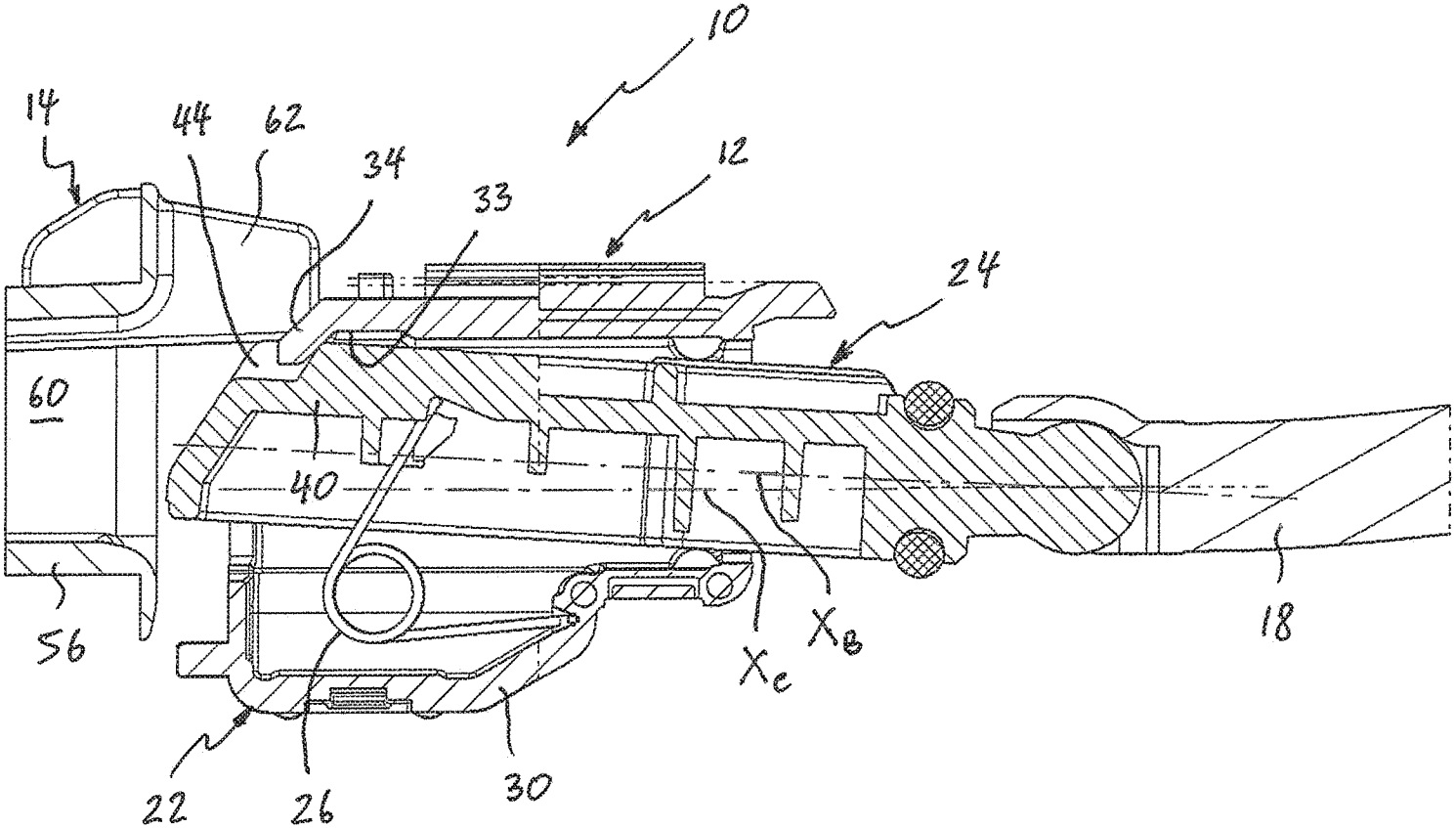

As illustrated in FIG. 16, upon further displacement of the lid 4 relative to the storage bin 2, the strike member 62 of each of the first and second strikers $\mathbf{14}_1$ and $\mathbf{14}_2$ pushes the contact rib 44 of the bolt body 40 of each of the first and second latch modules $\mathbf{12}_1$ and $\mathbf{12}_2$ downwardly away from the inner rest surface 33 of the casing body 30 of each of the first and second latch modules $\mathbf{12}_1$ and $\mathbf{12}_2$. In other words, the strike member 62 of the striker 14 imparts pivotal (or rotational) movement to the bolt body 40. At the same time, due to the biasing force of the torsion spring 26, the bolt body 40 concurrently moves axially away from the casing body 30 of each of the first and second latch modules $\mathbf{12}_1$ and $\mathbf{12}_2$ toward the latch pocket 60 of the corresponding one of the first and second striker $\mathbf{14}_1$ and $\mathbf{14}_2$. During the downward pivotal displacement of the bolt body 40 away from the inner rest surface 33 of the casing body 30, the bolt body 40 is guided by the contact rib 44 of the bolt body 40 sliding in the central slot 36 of the beveled control flange 34 of the casing body 30.

Figure 17:
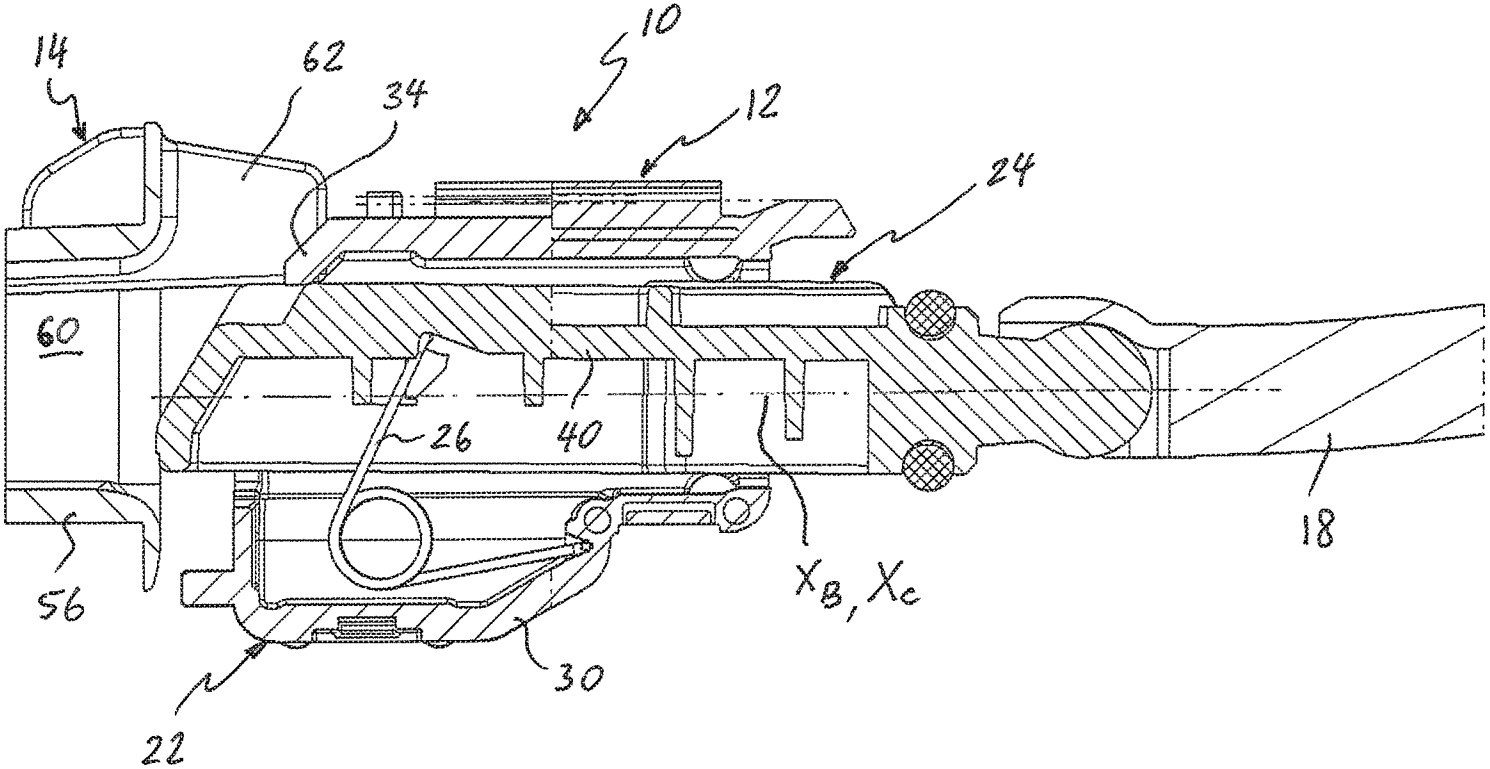

As illustrated in FIG. 17, upon further pivotal displacement of the latch bolt 24 of each of the first and second latch modules $\mathbf{12}_1$ and $\mathbf{12}_2$ away from the inner rest surface 33 of the casing body 30 against the biasing force of the torsion spring 26, the beveled outer retain surfaces 46 of the bolt body 40 are disengaged from the beveled inner retain surface $\mathbf{35}_2$ of the beveled control flange 34 of the casing body 30. In other words, the latch bolt 24 of each of the first and second latch modules $\mathbf{12}_1$ and $\mathbf{12}_2$ is free to linearly move coaxially with the longitudinal casing axis $X_C$ toward the latch pocket 60 of the corresponding first and second strikers $\mathbf{14}_1$ and $\mathbf{14}_2$ due to the biasing force of the torsion spring 26.

Figure 18:
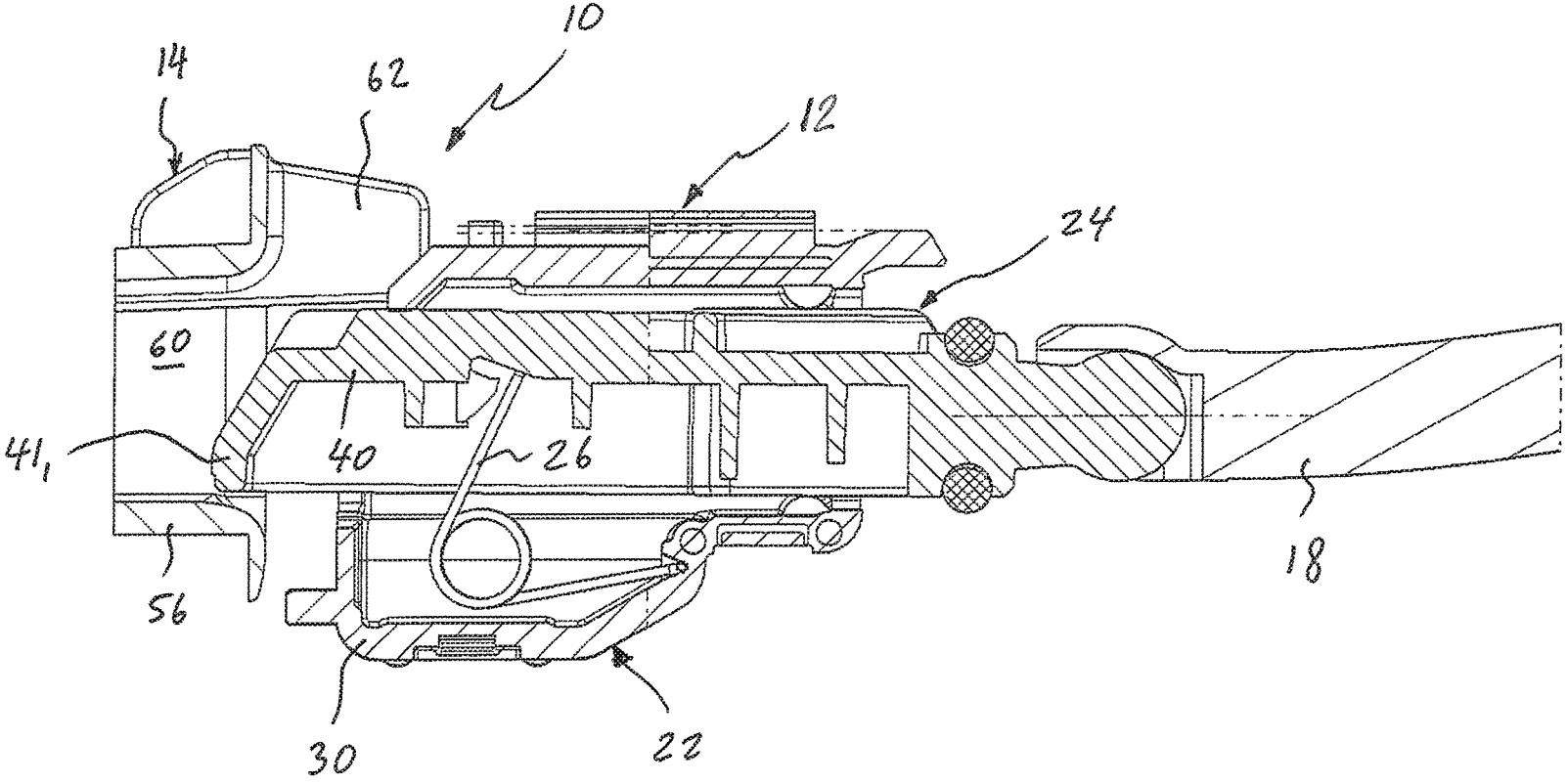

Upon further linear displacement of the latch bolt 24 toward the striker 14 due to the biasing force of the torsion spring 26, the free distal end $\mathbf{41}_1$ of the bolt body 40 of latch bolt 24 enters the latch pocket 60 of the striker 14, as illustrated in FIG. 18. In other words, the latch bolt 24 is released to the extended position after the lid 4 of the storage compartment 1 is closed.

Figure 19:
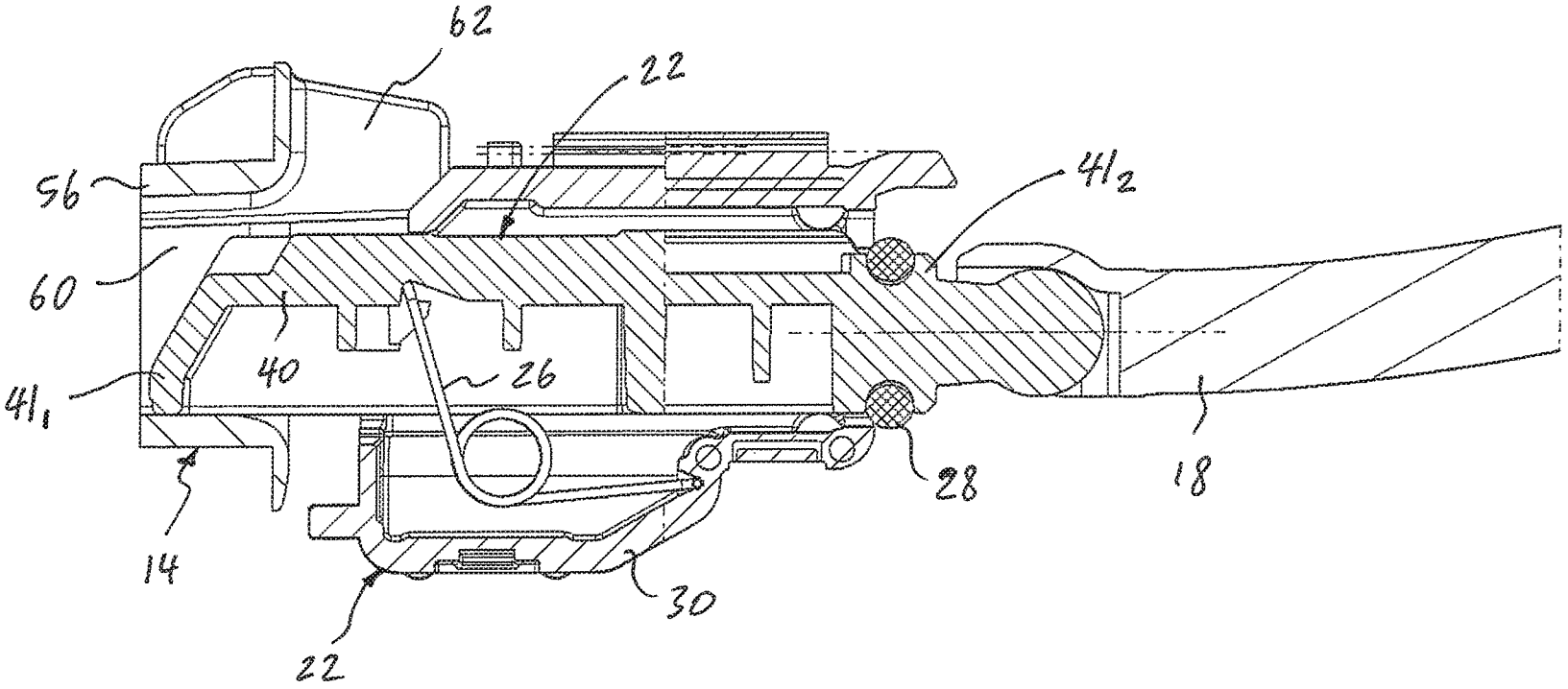

Finally, as illustrated in FIG. 19, the free distal end $\mathbf{41}_1$ of the bolt body 40 of latch bolt 24 further enters the latch pocket 60 of the striker 14 until the damping buffer 28 engages the casing body 30 of the latch casing 22 at the rear opening $\mathbf{31}_2$ thereof, thus placing the latch bolt 24 in the extended position and preventing the lid 4 from opening. Subsequently, the latch assembly 10 is in the latched position, and the lid 4 of the glove box 1 is in the closed position. Moreover, the latch bolt 24 of the latch assembly 10 of the present invention is released to the extended position after the lid 4 of the storage compartment 1 is closed. As a result, the latch assembly 10 decreases closing force to the lid 4, initial impact noise and parts deformation during closing of the lid 4.

Accordingly, the elongated latch bolt 24 of the present invention is moveable between the extended position, in which the longitudinal bolt axis $X_B$ of the latch bolt 24 is coaxial with the longitudinal casing axis $X_C$ of the latch casing 22, and the retracted position, in which the longitudinal bolt axis $X_B$ of the latch bolt 24 is oblique with respect to the longitudinal casing axis $X_C$ of the latch casing 22. Moreover, when the outer retain surfaces 46 of the latch bolt 24 is engaged with the inner retain surface $\mathbf{35}_2$ of the latch casing 22, the torsion spring 26 biases the latch bolt 24 toward the retracted position, and when the outer retain surfaces 46 of the latch bolt 24 is disengaged from the inner retain surface $\mathbf{35}_2$ of the latch casing 22, the torsion spring 26 biases the latch bolt 24 toward the extended position. The outer retain surfaces 46 of the latch bolt 24 is disengaged from the inner retain surface $\mathbf{35}_2$ of the latch casing 22 by the strike member 62 of the striker 14.

Therefore, the present invention provides a novel latch assembly for a storage compartment of an automotive vehicle. The novel latch assembly comprises a latch bolt that retained (or held) retracted when the storage compartment is open and is released to an extended (latched) position after a lid of the storage compartment is closed. This is enabled by a shape of a latch bolt/latch casing interface combined with a spring member and a striker fixed to the storage bin or, alternatively, to the lid of the storage compartment.

The foregoing description of the exemplary embodiments of the present invention has been presented for the purpose of illustration in accordance with the provisions of the Patent Statutes. It is not intended to be exhaustive or to limit the invention to the precise forms disclosed. The embodiments disclosed hereinabove were chosen in order to best illustrate the principles of the present invention and its practical application to thereby enable those of ordinary skill in the art to best utilize the invention in various embodiments and with various modifications as are suited to the particular use contemplated, as long as the principles described herein are followed. Thus, changes can be made in the above-described invention without departing from the intent and scope thereof. It is also intended that the scope of the present invention be defined by the claims appended thereto.

What is claimed is:

1. A latch assembly adapted to selectively secure a lid to a storage bin of an automobile storage compartment, the latch assembly having a latched position and an unlatched position, the latch assembly including a first latch module comprising:

a hollow latch casing forming a cavity and having an inner retaining surface within the cavity, a front opening and a rear opening coaxial with the front opening along a longitudinal casing axis of the hollow latch casing;

an elongated latch bolt extending through the cavity in the hollow latch casing; and a spring member disposed within the cavity in the hollow latch casing, the spring member having a bolt spring end engaging the elongated latch bolt and a casing spring end engaging the hollow latch casing;

the elongated latch bolt having a free distal end and a proximal end disposed along a longitudinal bolt axis of the elongated latch bolt, and an outer retaining surface configured to cooperate with the inner retaining surface of the hollow latch casing and disposed between the free distal end and the proximal end of the elongated latch bolt;

the elongated latch bolt moveable both axially and pivotally relative to the latch casing;

the elongated latch bolt moveable between an extended position, in which the longitudinal bolt axis of the latch bolt is coaxial with the longitudinal casing axis of the latch casing, and a retracted position, in which the longitudinal bolt axis of the latch bolt is oblique with respect to the longitudinal casing axis of the latch casing, wherein the latch bolt is retained in the retracted position via the spring member biasing the respective retaining surfaces one against the other;

and, wherein the first latch module further comprises a damping buffer mounted to the proximal end of the elongated latch bolt for limiting axial movement of the elongated latch bolt relative to the latch casing in the direction from the rear opening to the front opening of the latch casing, wherein the damping buffer is in the form of an O-ring made of an elastomeric material.

2. The latch assembly as defined in claim 1, wherein the spring member is in the form of a torsion spring.

3. The latch assembly as defined in claim 1, wherein the hollow latch casing includes a beveled control flange at the front opening of the hollow latch casing, wherein the beveled control flange obliquely extends radially inwardly toward the longitudinal casing axis and partially forms the front opening in the hollow latch casing, and wherein the beveled control flange has the inner retaining surface obliquely extending radially inwardly toward the longitudinal casing axis.

4. The latch assembly as defined in claim 3, wherein the beveled control flange further has a beveled outer surface obliquely extending radially inwardly toward the longitudinal casing axis and an inner guide surface parallel to the longitudinal casing axis.

5. The latch assembly as defined in claim 4, wherein the beveled control flange of the hollow latch casing has a central slot configured to guide the movement of the latch bolt relative to the latch casing, and wherein the free distal end of the latch bolt has a contact rib complementary to the central slot in the latch casing.

6. The latch assembly as defined in claim 5, wherein the central slot is formed centrally with respect to a transverse axis perpendicular to the longitudinal casing axis of the latch casing, and wherein the contact rib is formed centrally with respect to a transverse axis perpendicular to the longitudinal bolt axis of the latch bolt.

7. The latch assembly as defined in claim 5, wherein the beveled control flange of the hollow latch casing has an inner guide surface, and wherein the elongated latch bolt has at least one outer guide surface configured to selectively engage the inner guide surface of the beveled control flange.

8. The latch assembly as defined in claim 1, wherein the free distal end of the latch bolt has a flat, beveled contact surface.

9. The latch assembly as defined in claim 1, further comprising a first striker such that the first latch module is moveable relative to the first striker between the latched position and the unlatched position of the latch assembly; wherein in the extended position the free distal end of the latch bolt engages the first striker and the longitudinal bolt axis of the latch bolt is coaxial with the longitudinal casing axis of the latch casing, and wherein in the retracted position the free distal end of the latch bolt is disengaged from the first striker and the longitudinal bolt axis of the latch bolt is oblique with respect to the longitudinal casing axis of the latch casing.

10. The latch assembly as defined in claim 9, wherein the first striker includes a latch pocket configured to receive the free distal end of the elongated latch bolt therewithin in the extended position of the latch bolt so as to place the latch assembly in the latched position, and a strike member axially extending from the first striker toward the first latch module and configured to engage the latch bolt in the direction perpendicular to the longitudinal casing axis of the latch casing in order to move the latch bolt to the retracted position so as to place the latch assembly in the unlatched position.

11. The latch assembly as defined in claim 1, further comprising an actuator assembly activatable by a user for selectively moving the latch assembly between the latched and unlatched positions, and a first connecting rod operatively connecting the actuator assembly to the first latch module.

12. The latch assembly as defined in claim 4, further comprising a second striker and a second latch module moveable relative to the second striker, wherein the second striker is arranged axially opposite to the first striker, wherein the second latch module is arranged axially opposite to the first latch module, and wherein the second striker and the second latch module are functionally and structurally identical to the first striker and the first latch module.

13. The latch assembly as defined in claim 12, further comprising a second connecting rod operatively connecting the first latch module to the second latch module.

14. The latch assembly as defined in claim 13, further comprising a coupler operatively connecting to the first connecting rod to the second connecting rod so as to synchronize the first and second latch modules.

15. The latch assembly as defined in claim 9, wherein the storage bin forms a storage cavity therein, wherein the lid is pivotally mounted to the storage bin so as to move between an open position allowing access to the storage cavity and a closed position preventing access to the storage cavity, and wherein the latch assembly is configured to selectively secure the lid to the storage bin in the closed position.

16. The latch assembly as defined in claim 15, wherein the first latch module is mounted to one of the lid and the storage bin of the storage compartment, and wherein the first striker is mounted to the other of the lid and the storage bin of the storage compartment.

17. The latch assembly as defined in claim 16, further comprising an actuator assembly activatable by a user for selectively moving the latch assembly between the latched and unlatched positions, and a first connecting rod operatively connecting the actuator assembly to the first latch module.

18. The latch assembly as defined in claim 17, further comprising a second striker and a second latch module moveable relative to the second striker, wherein the second striker is arranged axially opposite to the first striker, wherein the second latch module is arranged axially opposite to the first latch module, wherein the second striker and the second latch module are functionally and structurally identical to the first striker and the first latch module, wherein the second latch module is mounted to one of the lid and the storage bin the storage compartment, and wherein the second striker is mounted to another of the lid and the storage bin of the storage compartment.

* * * * *